US008983082B2

(12) United States Patent
Maxwell et al.

(10) Patent No.: US 8,983,082 B2
(45) Date of Patent: Mar. 17, 2015

(54) DETECTING MUSICAL STRUCTURES

(75) Inventors: Cynthia Maxwell, Portola Valley, CA (US); Frank Martin Ludwig Gunter Baumgarte, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 1313 days.

(21) Appl. No.: 12/760,522

(22) Filed: Apr. 14, 2010

(65) Prior Publication Data

US 2011/0255700 A1 Oct. 20, 2011

(51) Int. Cl.

| | |
|---|---|
| ***H04R 29/00*** | (2006.01) |
| ***G10H 1/043*** | (2006.01) |
| ***G10H 1/40*** | (2006.01) |
| ***H04R 5/027*** | (2006.01) |
| ***G10H 1/36*** | (2006.01) |

(52) U.S. Cl.

CPC ..... *H04R 5/027* (2013.01); *G10H 1/368* (2013.01); *G10H 1/40* (2013.01); *H04S 2400/15* (2013.01); *G10H 2210/076* (2013.01)

USPC ..... 381/58; 381/61; 84/611; 84/612; 84/635; 84/636

(58) Field of Classification Search

USPC ..... 381/58, 61–63; 84/635–636, 639–643, 84/611–612; 700/94

See application file for complete search history.

(56) References Cited

U.S. PATENT DOCUMENTS

| | | | | |
|---|---|---|---|---|
| 6,316,712 | B1 | 11/2001 | Laroche | |
| 7,183,479 | B2 | 2/2007 | Lu et al. | |
| 7,254,455 | B2 | 8/2007 | Moulios | |
| 7,569,761 | B1 | 8/2009 | Iampietro et al. | |
| 2008/0034947 | A1 * | 2/2008 | Sumita | 84/613 |

OTHER PUBLICATIONS

D. Eck, A tempo-extraction algorithm using an autocorrelation phase matrix and shannon entropy. In *MIREX*, 2005.

D. Eck, Identifying metrical and temporal structure within an autocorrelation phase matrix. *Music Perception*, 24(2): 167-176, 2006.

D. Eck, Beat tracking using an autocorrelation phase matrix. *Proc. ICASSP*, pp. IV-1313-IV-1316, 2007.

D. Eck and N. Casagrande, Finding meter in music using an autocorrelation phase matrix and shannon entropy. In ISMIR, 2005.

* cited by examiner

*Primary Examiner* — Duc Nguyen
*Assistant Examiner* — George Monikang
(74) *Attorney, Agent, or Firm* — Blakely, Sokoloff, Taylor & Zafman LLP

(57) ABSTRACT

Among other things, techniques and systems are disclosed for detecting musical structures, such as downbeats. In one aspect, a method performed by a data processing device includes receiving an input audio signal. The method includes detecting a meter in the received audio signal. Detecting the meter includes generating an envelope of the received audio signal; generating an autocorrelation phase matrix having a two-dimensional array based on the generated envelope to identify a dominant periodicity in the received audio signal; and filtering both dimensions of the generated autocorrelation phase matrix to enhance peaks in the two-dimensional array. The meter represents a time signature of the input audio signal having multiple beats. Additionally, the method includes identifying a downbeat as a first beat in the detected meter.

25 Claims, 24 Drawing Sheets

222

226

232

234

262

DETECTING MUSICAL STRUCTURES

BACKGROUND

This application relates to digital audio signal processing. A musical piece can represent an arrangement of different events or notes that generates different beats, pitches, rhythms, timbre, texture, etc. as perceived by the listener. Detection of musical events in an audio signal can be useful in various applications such as content delivery, digital signal processing (e.g., compression), data storage, etc. To accurately and automatically detect musical events in an audio signal, various factors, such as the presence of noise and reverb, may be considered. Also, detecting a note from a particular instrument in a multi-track recording of multiple instruments can be a complicated and difficult process.

SUMMARY

In one aspect, selectively detecting musical structures is described. A method performed by a data processing device includes receiving an input audio signal. The method includes detecting a meter in the received audio signal. Detecting the meter includes generating an envelope of the received audio signal; generating an autocorrelation phase matrix having a two-dimensional array based on the generated envelope to identify a dominant periodicity in the received audio signal; and filtering both dimensions of the generated autocorrelation phase matrix to enhance peaks in the two-dimensional array. The meter represents a time signature of the input audio signal having multiple beats. Additionally, the method includes identifying a downbeat as a first beat in the detected meter.

Implementations can optionally include one or more of the following features. Generating the envelope can include generating an analytic signal based on the received input audio signal. Detecting the meter can include downsampling the generated envelope to reduce a complexity of the estimated envelope. Detecting the meter can include determining a correlation between the generated envelope and a time shifted version of the generated envelope. The time shifted version can be shifted in time by a time lag. The time lag can represent an integer multiple of a beat rate of the received input audio signal. Generating the autocorrelation phase matrix can include computing the autocorrelation phase matrix having the two-dimensional array based on the determined correlation. A first dimension of the two-dimensional array can be associated with the time lag and a second dimension of the two-dimensional array can be associated with a phase shift between the generated envelope and the time shifted version. Computing the autocorrelation phase matrix can include varying a length of the time lag in the first dimension; and varying a size of the phase shift in the second dimension.

Implementations can optionally include one or more of the following features. Detecting the meter can include generating an enlarged autocorrelation phase matrix by extending the filtered autocorrelation phase matrix in the second dimension to avoid a triangular shape in the autocorrelation phase matrix. Detecting the meter can include performing a circular autocorrelation operation on the generated enlarged autocorrelation phase matrix using an autocorrelation function. Detecting the meter can include generating a smoothed autocorrelation function that removes a variable offset from the autocorrelation function. Detecting the meter can include subtracting the generated smoothed autocorrelation function from the autocorrelation function; removing a DC offset from a result of the subtracting; and identifying peaks of the autocorrelation function. Detecting the meter in the received audio signal further can include applying a weighting function to the autocorrelation function to reduce a number of false detection of peaks. Detecting the meter can include identifying a location of a highest peak from the detected peaks; and removing remaining peaks from the autocorrelation function. Detecting the meter further can include cleaning the autocorrelation function using a threshold value. Detecting the meter can include testing the autocorrelation function using multiple meter templates; and responsive to the testing, identifying the meter in the received audio signal. Identifying a downbeat as a first beat in the detected meter can include identifying a strongest beat from the multiple beats within the detected meter; and comparing the identified strongest beat with neighboring beats to detect the downbeat as the first beat in the detected meter. Identifying a downbeat as a first beat in the detected meter can include identifying a first beat from the multiple beats within the detected meter; and comparing the identified first beat with neighboring beats to detect the downbeat as the first beat in the detected meter. The method can include using the detected downbeat to synchronize the received audio signal with a video signal.

In another aspect, a system includes a user input unit to receive an input audio signal. The system includes a meter detection unit to deconstruct the received input audio signal to detect at least one temporal location associated with a change in the input audio signal. The temporal location includes a meter that contains multiple beats. The system includes a downbeat detection unit to: identify a downbeat as a first beat in the detected meter, and identify boundaries of the received input audio signal based on the detected downbeat. The system includes a data compression unit to: receive the identified boundaries from the downbeat detection unit, and perform data compression using the identified boundaries as markers for compressing data.

In yet another aspect, a data processing device includes a digital signal processing unit to detect downbeats in an audio signal. The digital signal processing unit can include a meter detection unit to detect a meter in the received audio signal, wherein the meter comprises multiple beats; and a downbeat detection unit to identify a downbeat as a first beat in the detected meter, and identify boundaries of the received audio signal based on the detected downbeat. The digital signal processing unit is configured to use the identified boundaries as triggers for executing one or more operations in the data processing device or a different device.

Implementations can optionally include one or more of the following features. The digital signal processing unit can be configured to synchronizing the received audio signal with video data based on the identified boundaries. The digital signal processing unit can be configured to realigning recorded audio data based on the identified boundaries. The digital signal processing unit is configured to mix two different audio data together by aligning the identified boundaries. The data processing device can include a data compression unit to perform data compression using the identified boundaries as markers for data compression.

In yet another aspect, a non-transitory computer readable storage medium embodying instructions, which, when executed by a processor, cause the processor to perform operations including detecting a meter in the received audio signal, wherein the meter contains multiple beats. The operations include identifying a downbeat as a first beat in the detected meter. The operations includes identifying boundaries of the received audio signal based on the detected downbeat; and using the identified boundaries as markers for deconstructing the received input audio signals into multiple components.

Implementations can optionally include one or more of the following features. Using the identified boundaries as markers for deconstructing the received input audio signals into multiple components can include compressing the input audio signal. Using the identified boundaries as markers for deconstructing the received input audio signals into multiple components can include rearranging the input audio signal. Using the identified boundaries as markers for deconstructing the received input audio signals into multiple components can include synchronizing the input audio signal with a video signal.

The techniques, system and apparatus as described in this specification can potentially provide one or more of the following advantages. For example, using downbeat information, applications such as audio and video editing software can be implemented to provide the user with editing points that can aid audio/video synchronization. In addition, downbeats can be used to re-align recorded music. Downbeats can also be used in automated DJ applications where two songs are mixed together by aligning beats and bar times. Additionally, downbeats can be used for compression algorithm.

BRIEF DESCRIPTION OF THE DRAWINGS

Like reference symbols and designations in the various drawings indicate like elements.

DETAILED DESCRIPTION

Techniques, apparatus and systems are described for detecting musical structures in an audio signal that are larger than onsets, beats, and tempo. Examples of these larger musical structures can include downbeats that represent musical boundaries that mark temporal locations in a musical piece where important changes happen. By marking the locations of important musical changes, downbeats can be used to encode salient features of a musical piece. Downbeats can be identified as the first beat in a measure and thus can be used to signal the start of a measure. While downbeats represent symbolic significance, downbeats can be difficult to detect because of their prominence in a musical piece can vary between different performances.

Figure 1:
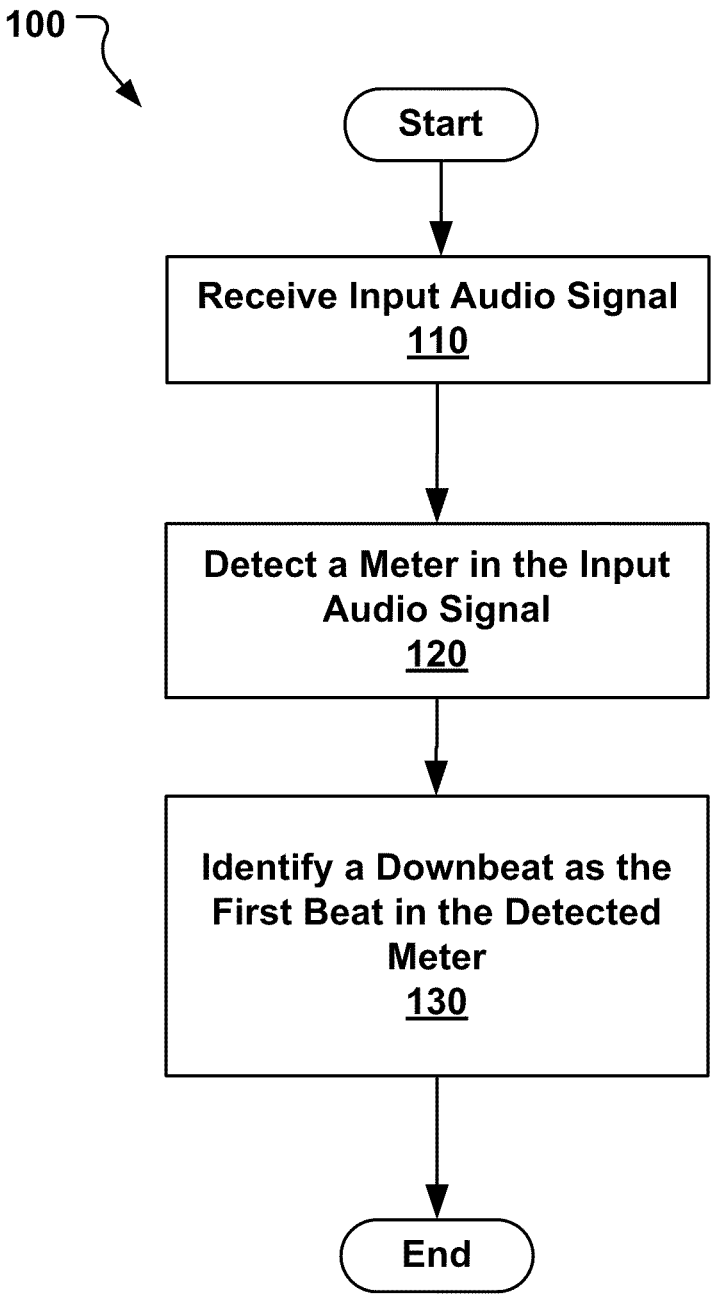
FIG. 1 shows an exemplary method of identifying the placements or locations of measure boundaries in an audio signal.

FIG. 1 shows an exemplary method 100 of identifying the placements or locations of measure boundaries in an audio signal. A data processing system or apparatus receives or selects from a data repository an input audio signal (110). The system or apparatus can include an integrated microphone or an externally attached microphone for receiving the input audio signal from an external source. The system or apparatus can process the input audio signal to detect a meter (or bar) in the input audio signal (120). The meter represents the time signature of the input audio signal. Moreover, the system or apparatus can identify a downbeat as the first beat in the detected meter (140). For example, in the detected meter, all of the unimportant or undesirable beats can be trimmed away to reveal the downbeat.

Figure 2A:
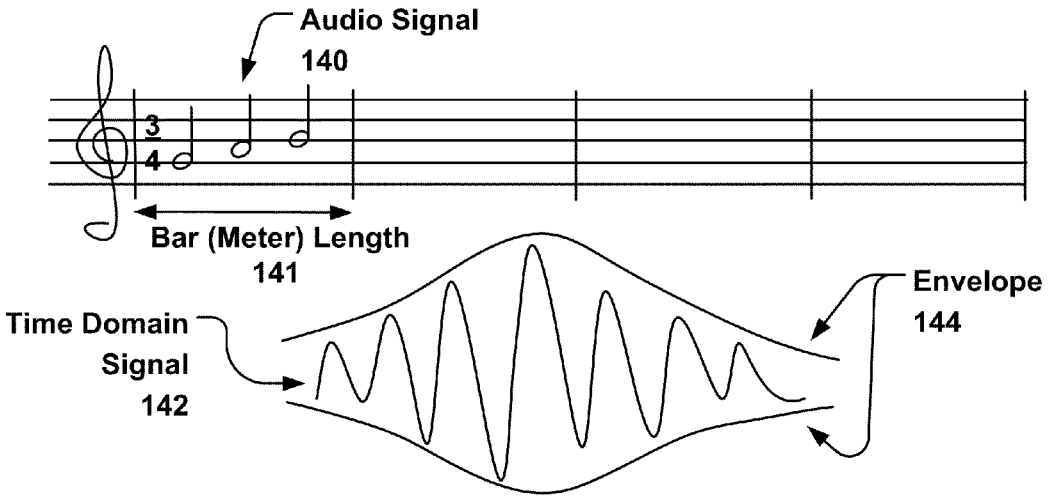
FIG. 2A shows an exemplary audio signal to be processed for meter detection.

FIGS. 2A, 2B, 2C, 2D, 2E, 2F, 2G, 2H, 2I, 2J, 2K, 2L, 2M, 2N, 2O, 2P, 2Q, 2R, 2S, 2T, and 2U in combination show an exemplary method 130 of detecting a meter in the input audio signal. FIG. 2A shows an exemplary audio signal 140 to be processed for meter detection. As an example, four bars or meters of the audio signal 140 having a ¾ meter is shown. A time domain signal 142 of the audio signal 140 is shown below the audio signal 140. The time domain signal 142 can be processed to estimate an envelope 144 of the time domain signal. Estimating the envelope is described further with respect to FIG. 2C below. The estimated envelope 144 can be used to determine the meter in the audio signal 140.

Figure 2B:
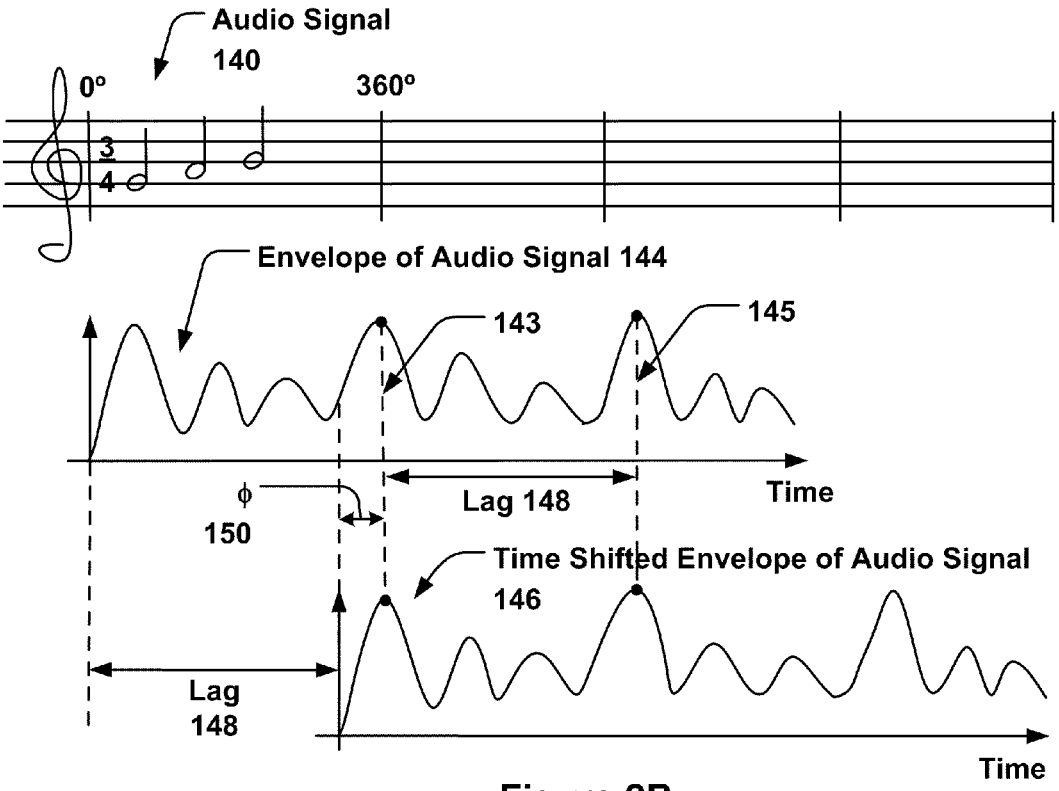
FIG. 2B shows using an envelop signal to detect a meter in an audio signal.

FIG. 2B shows using an envelop signal to detect a meter in an audio signal. For example, the envelope 144 is multiplied with a time shifted version 146 (e.g., shifted by a time lag 148) of itself. The phase, phi ($\phi$) 150, represents the distance from the bar to the current time sample. The envelope signal 144 and the time shifted envelope signal 146 are multiplied together, sample-by-sample, and the sum of the multiplications are used to determine a correlation between the two signals. For example, to obtain the estimation of the correlation between the envelope signal 144 and the shifted version 146, samples of the envelope signal 144 between points 143 and 145 (length of the lag 148) are multiplied with samples of the shifted version 146 between the same points 143 and 145. The results of the multiplications are added together. The sum of the products for each meter is provided as a row of an autocorrelation phase matrix (APM).

The APM is described further with respect to FIG. 2C below. If the time lag 148 between the two signals (the envelope 144 and the time shifted envelope 146) is equal to the meter (or bar), then the correlation is high (e.g., correlation coefficient approaches '1'). Else if the lag 148 is different form the meter, then the correlation is low (e.g., correlation coefficient approaches '0'). Different values can be used for the time lag 148 to take into account different meter lengths.

Figure 2C:
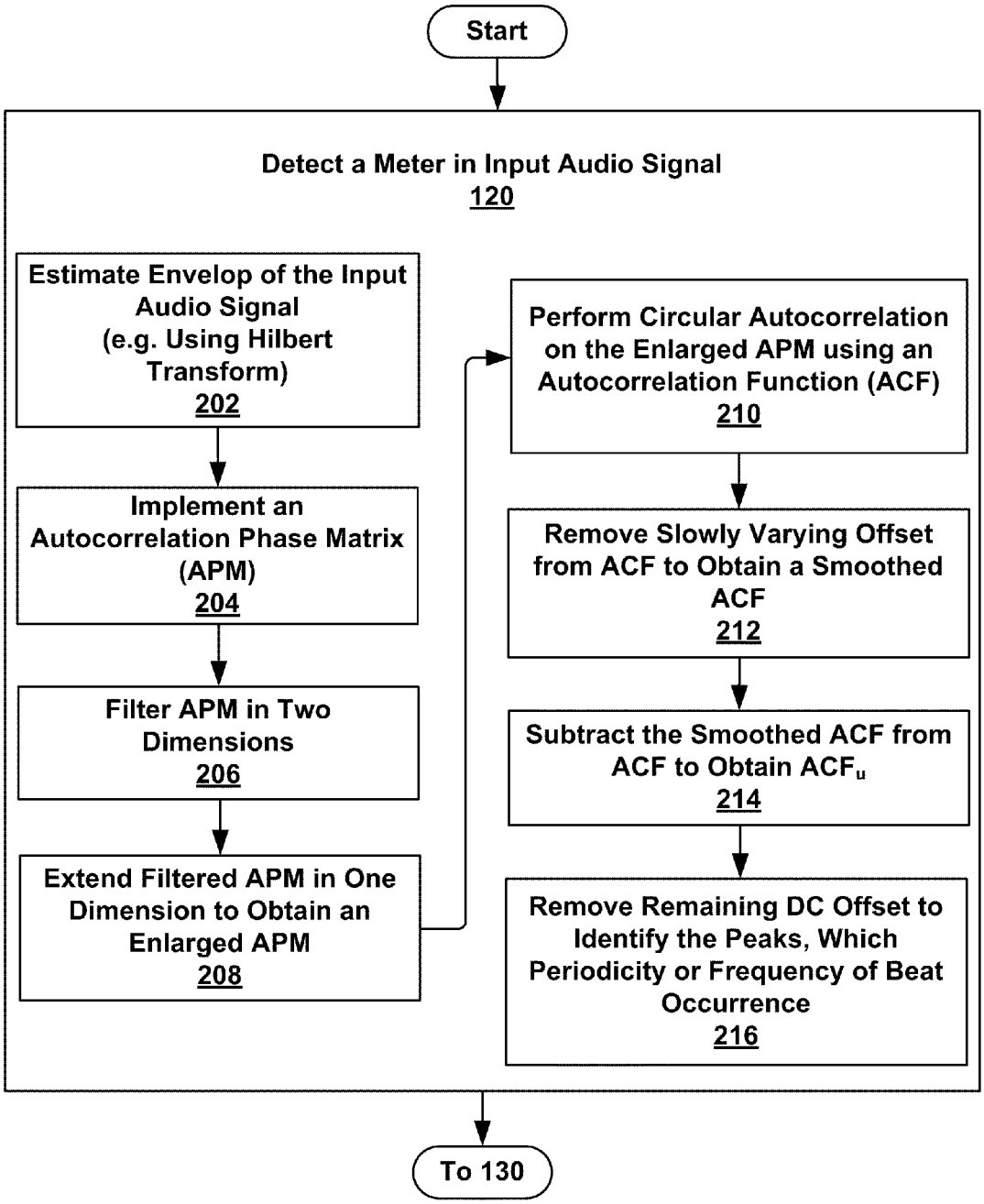
FIG. 2C is a process flow diagram of an exemplary method of detecting beats in an input audio signal.
Figure 2D:
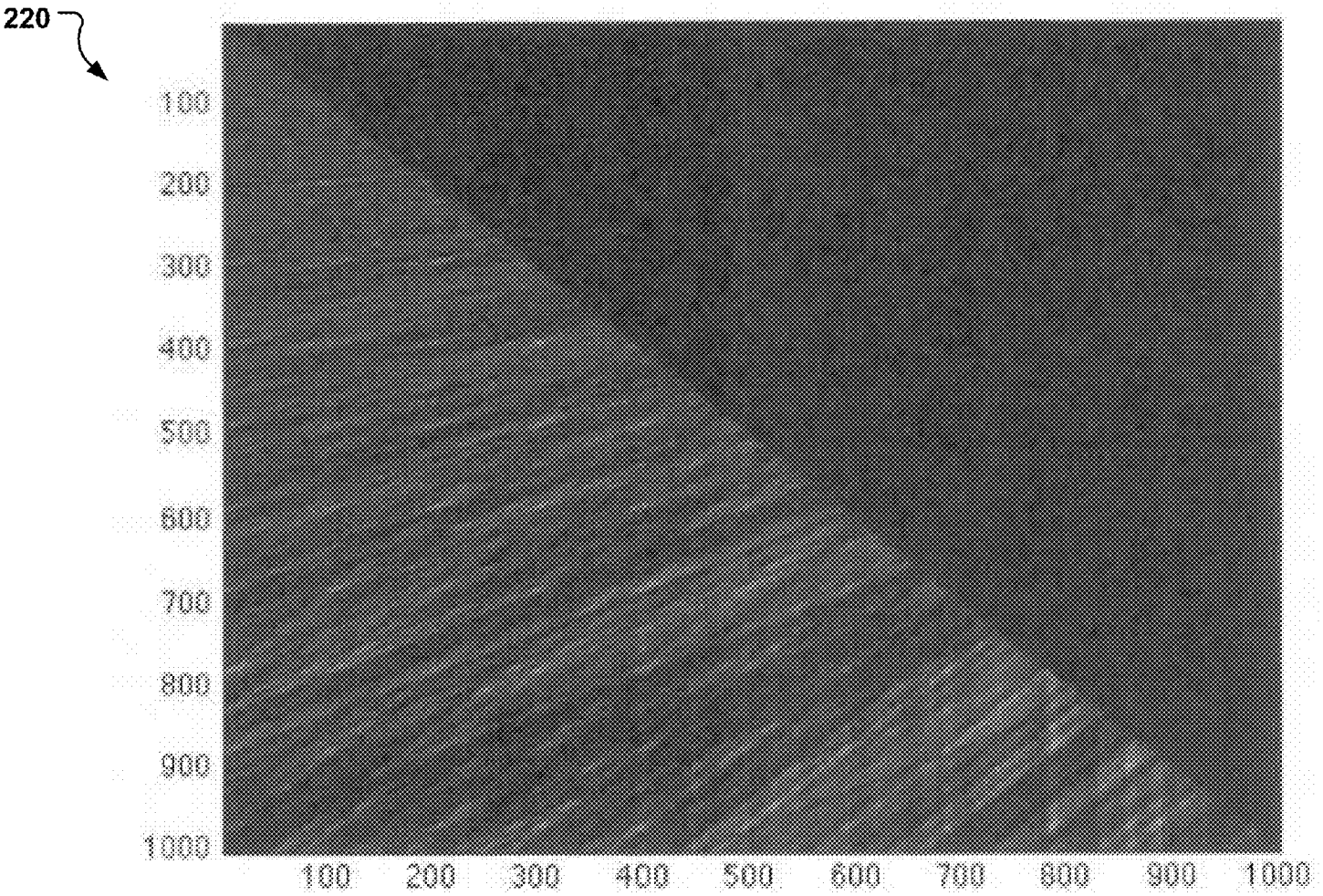
FIG. 2D is a graph that shows an autocorrelation phase matrix (APM) matrix with lower amplitudes appearing darker than the higher amplitudes.
Figure 2E:
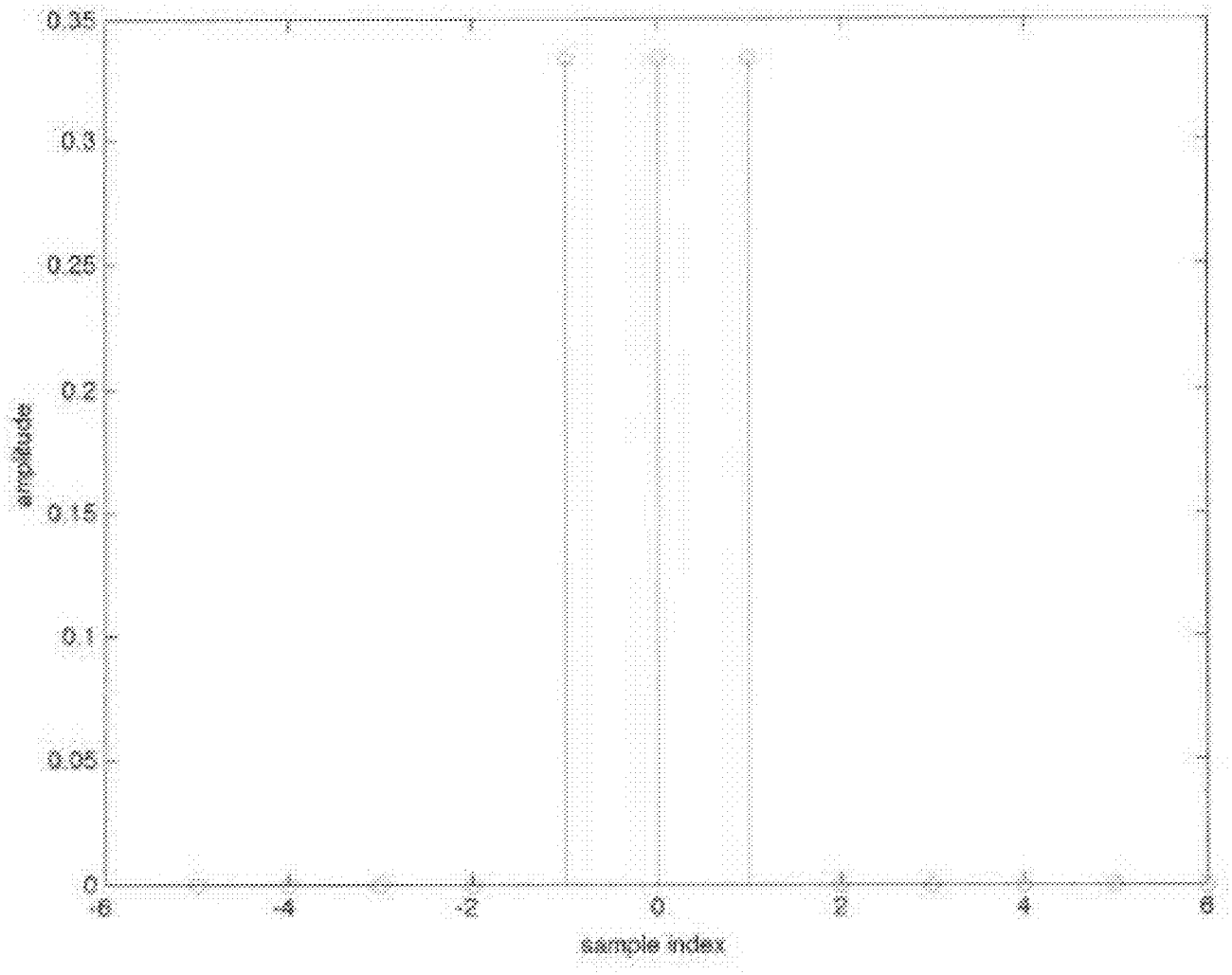
FIG. 2E is a graph that shows an exemplary lowpass filter.
Figure 2F:
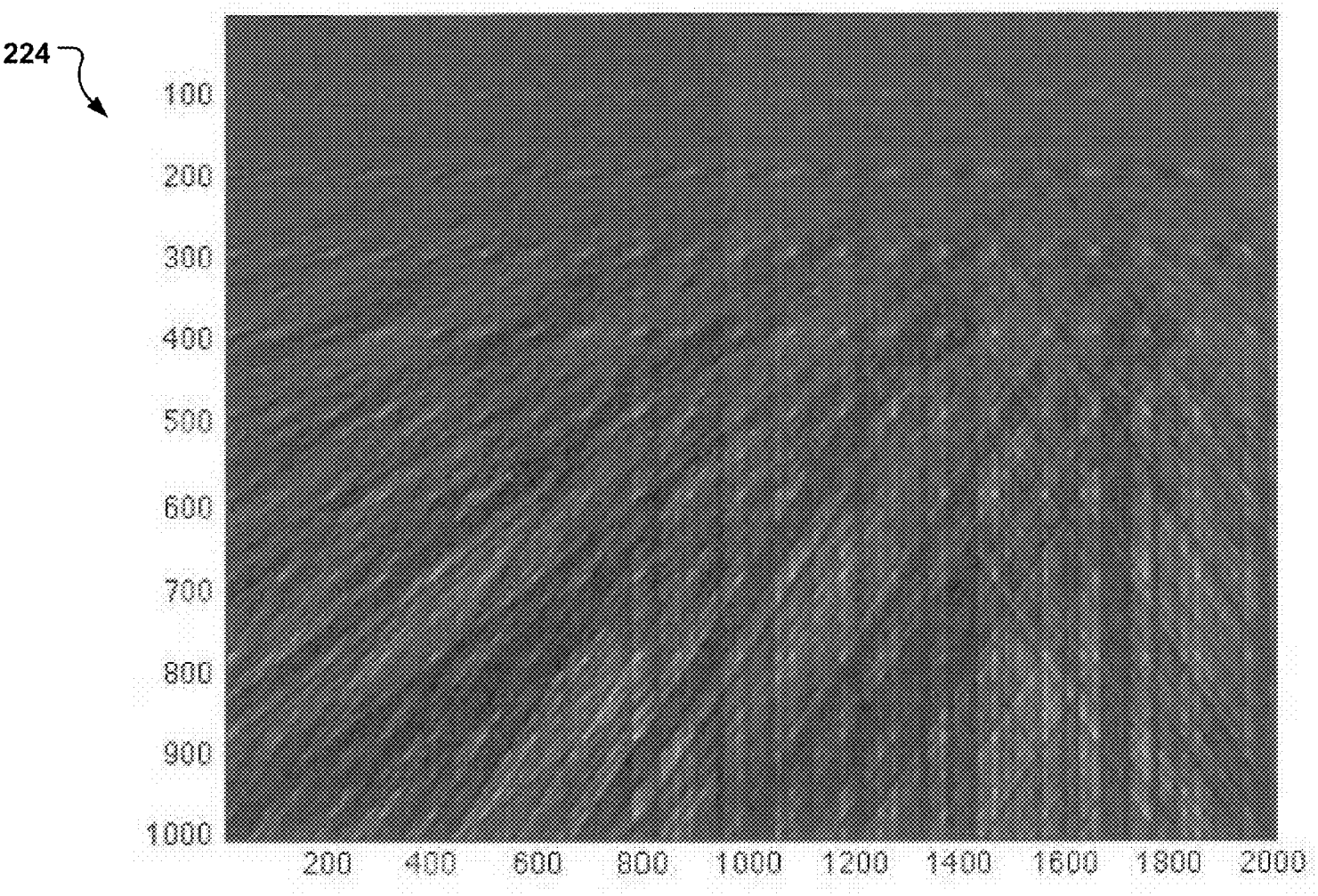
FIG. 2F is a graph that shows an extended APM matrix.
Figure 2G:
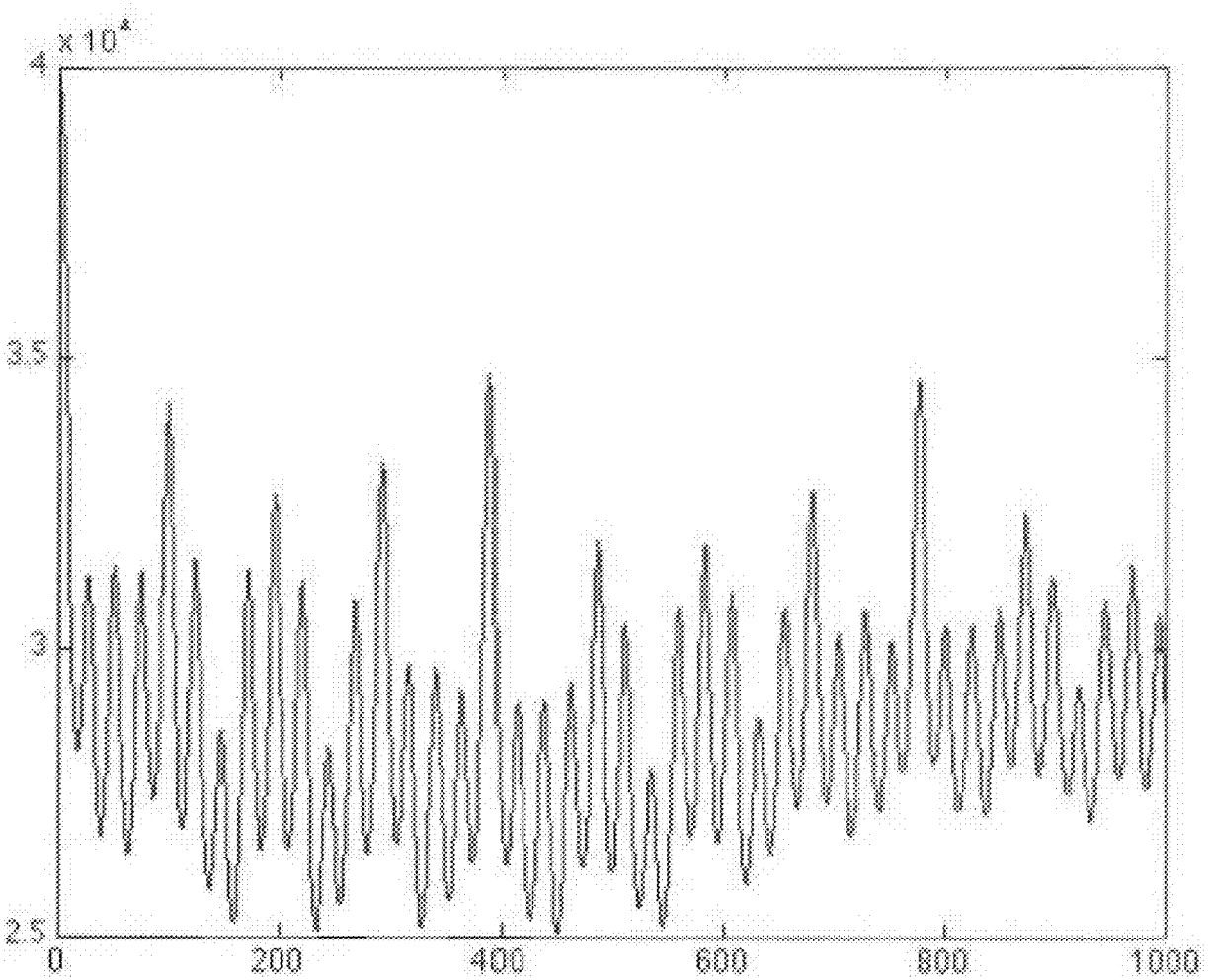
FIG. 2G is a graph that shows an autocorrelation function (ACF).
Figure 2H:
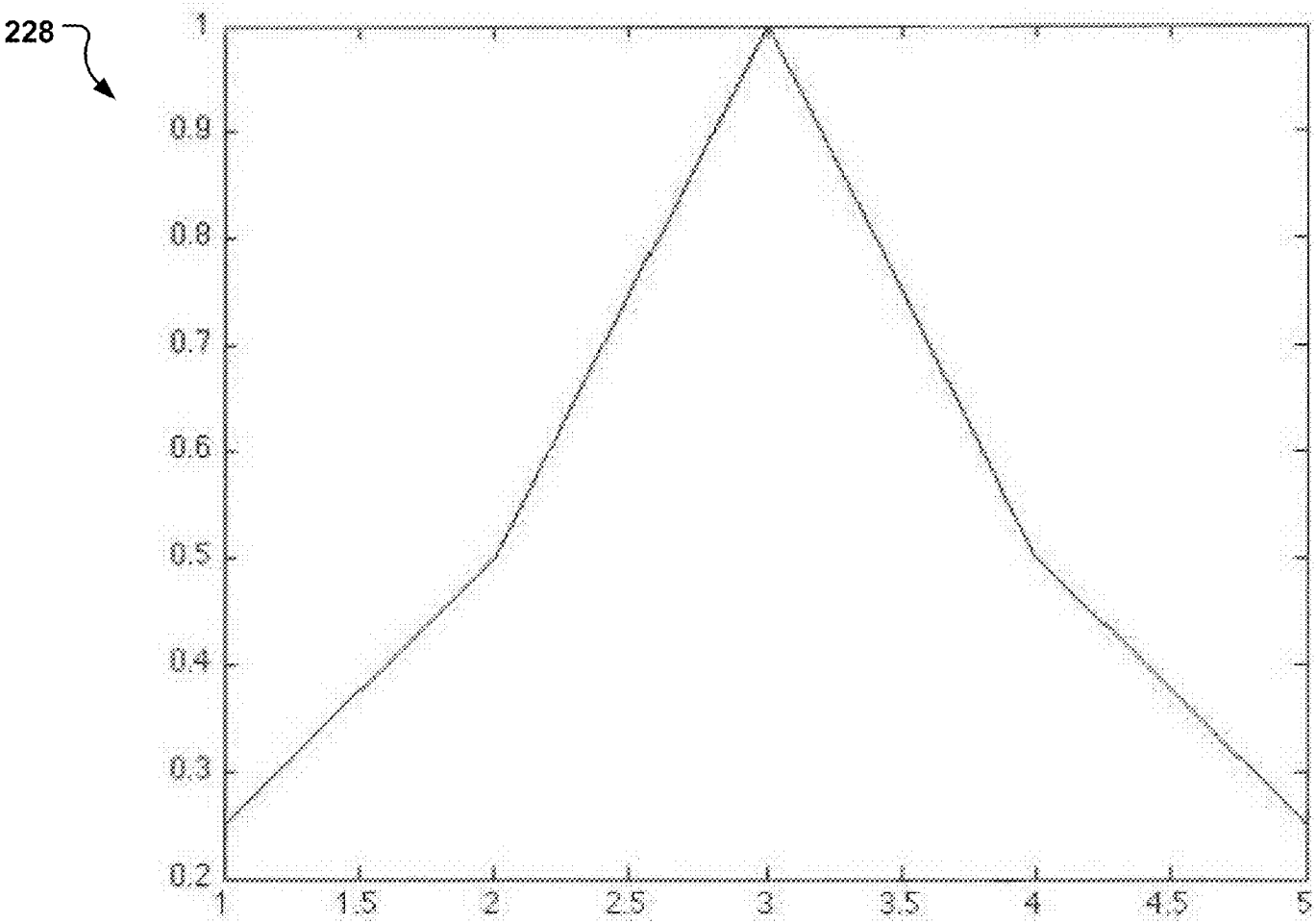
FIG. 2H is a graph that shows a smoothing function.
Figure 2I:
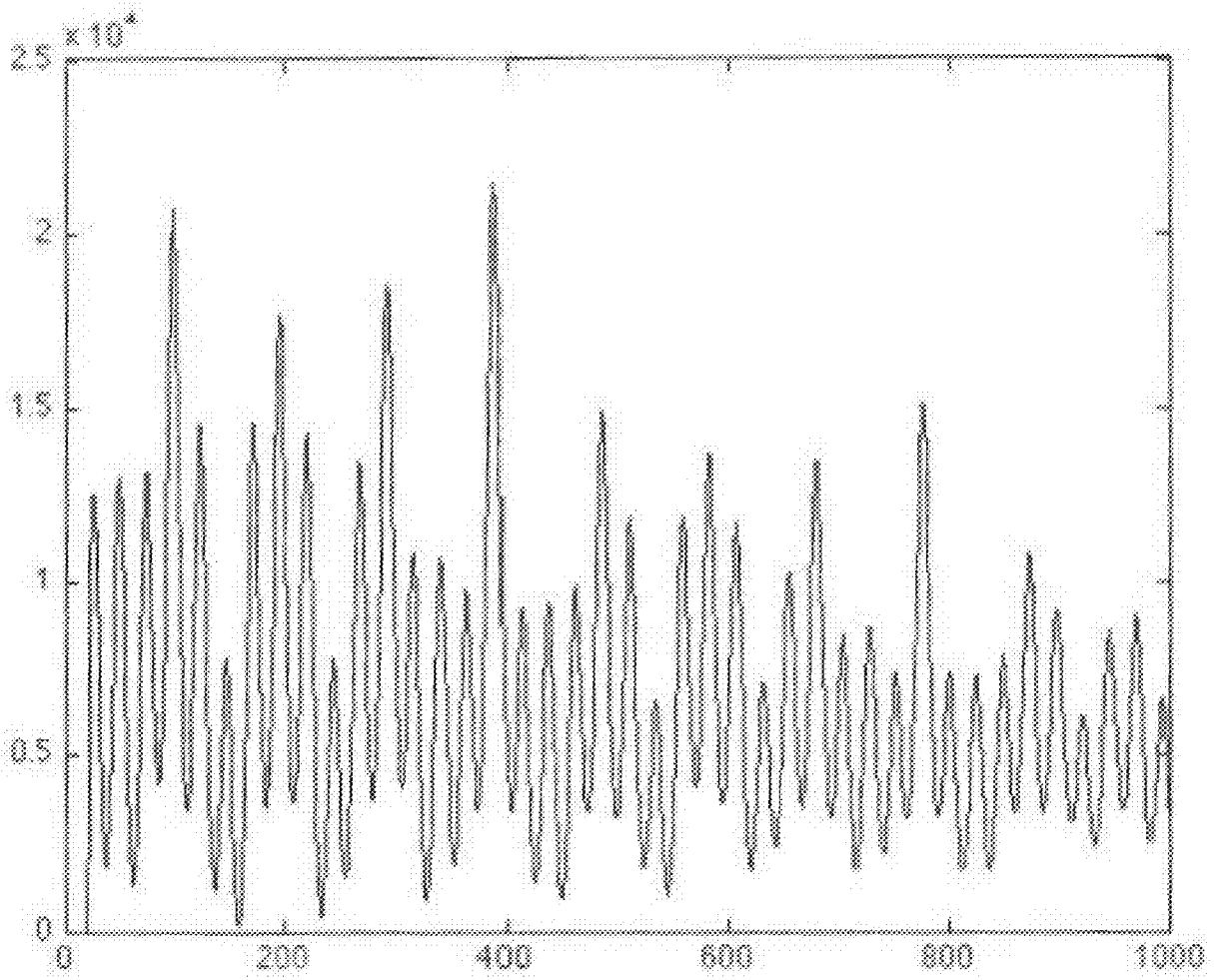
FIG. 2I is a graph that shows an unbiased correlation function ACFu.
Figure 2J:
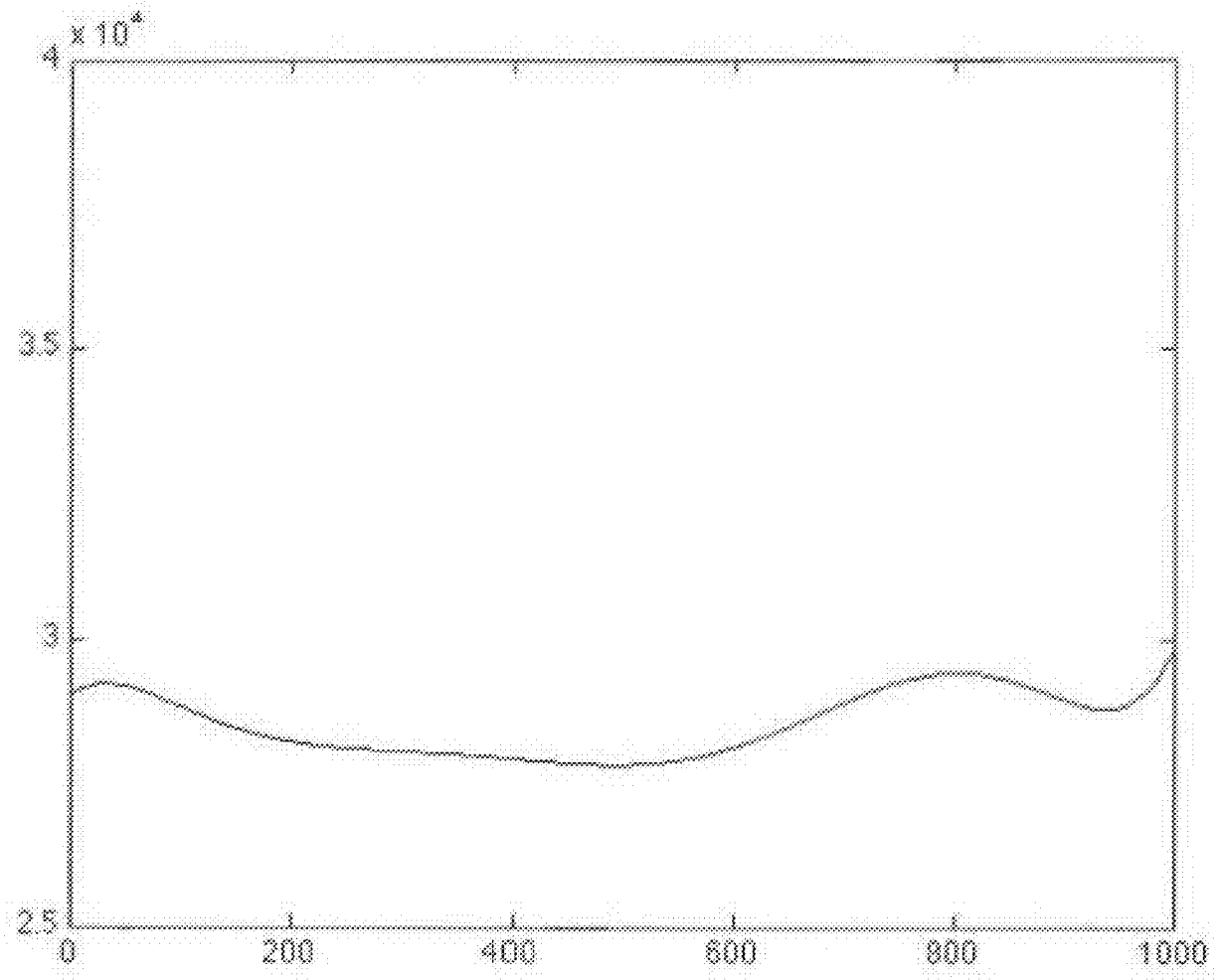
FIG. 2J is a graph that shows a DC offset estimate.
Figure 2K:
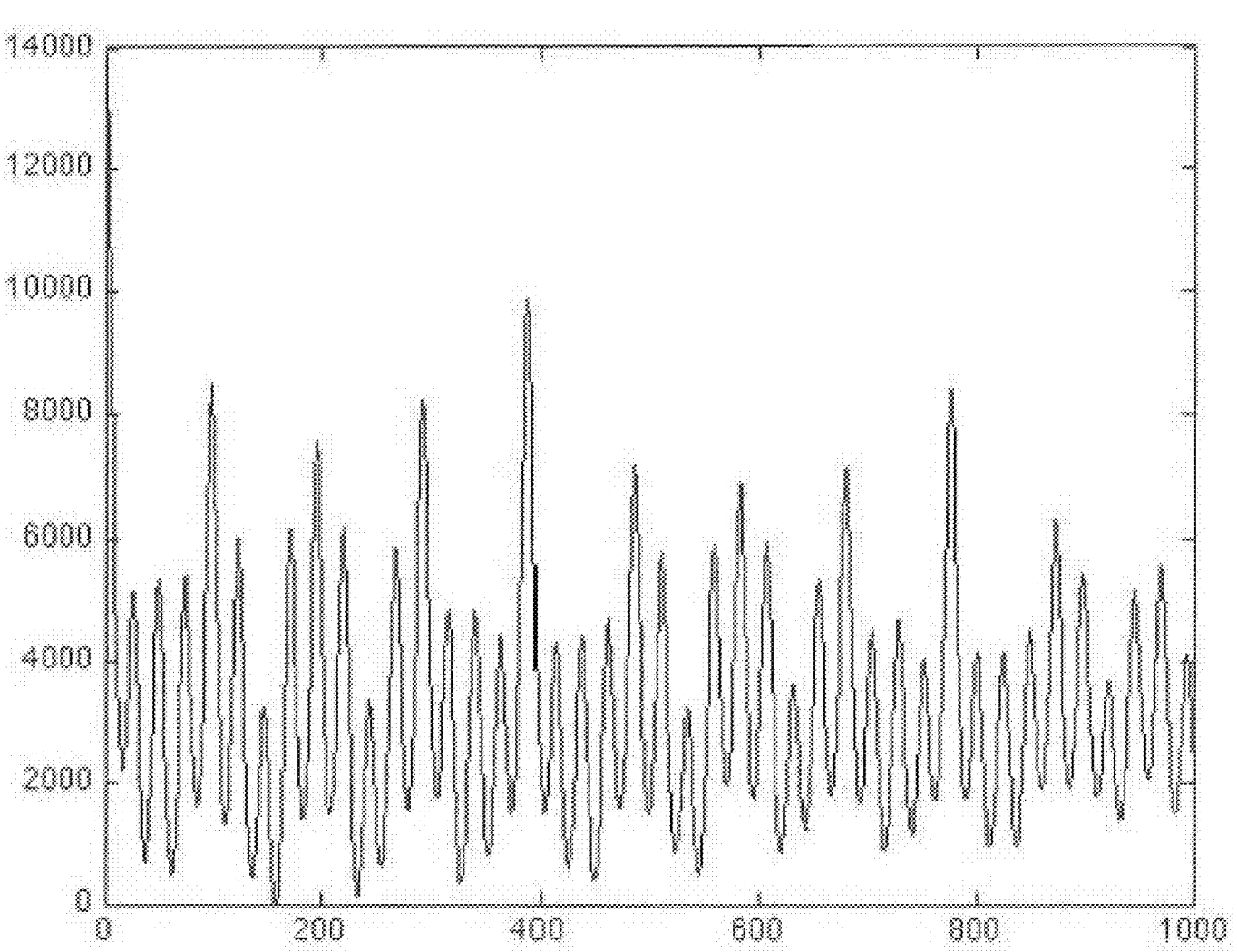
FIG. 2K is a graph that shows an ACF after removal of DC offset estimate.
Figure 2L:
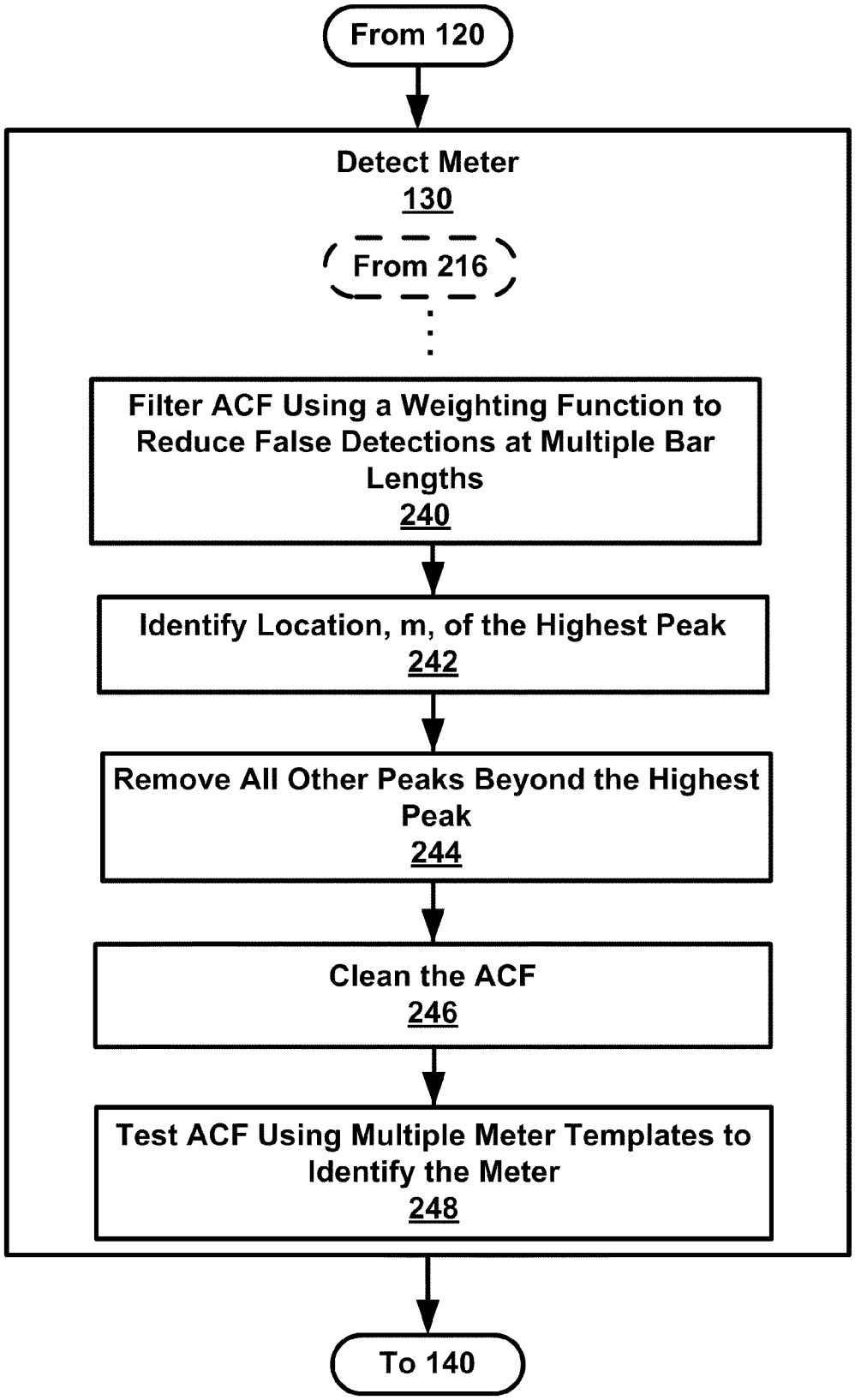
FIG. 2L is a process flow diagram of an example process for detecting a meter in an input audio signal.

FIGS. 2C and 2L are process flow diagrams of the exemplary method 120 of detecting a meter (or bar) in the input audio signal. FIGS. 2D, 2E, 2F, 2G, 2H, 2I, 2J, 2K, 2M, 2N, 2O, 2P, 2Q, 2R, 2S, 2T and 2U represent various data graphs associated with the meter detecting process 120.

The system or apparatus can perform various data processing operations on the input audio signal 140 to detect a meter in the input audio signal 140. An envelope is estimated for the input audio signal (202). For example, as shown in FIG. 2C, the system or apparatus can perform a Hilbert transformation on the input audio signal to generate an analytic signal whose magnitude is an envelope of the input audio signal. One reason for approximating the envelope is that the envelope is correlated with the perceived instantaneous loudness of the audio input signal. This is because the beats in general are often associated with temporal loudness increases, and the phase information can be discarded for this purpose.

Other techniques can be used to detect the envelope. For example, while less accurate than using the Hilbert transform, an approximated envelope can be generated by: 1) calculating the magnitude of the signal; and 2) applying a low-pass filter.

The generated envelope can be useful because of its low-pass characteristics and because it allows the system or apparatus to ignore the phase information in the input audio signal. The envelope can be downsampled (e.g., to 100 Hz to decrease the size of the problem. The frequency should be at least as high as twice the maximum expected beat rate. The accuracy of the detection can be higher, if the sample rate is higher than the maximum expected beat rate. Thus, the downsampling process provides complexity reduction. Reducing the size of the problem includes reducing the size of the matrix and subsequent search space. The more downsampled the envelope, the smaller the matrix, but also reduces the accuracy of the results.

Responsive to the generated analytic signal, an autocorrelation phase matrix (APM) is implemented (204). In general, the APM can be used to show the auto-correlation of the envelope. Each matrix entry is calculated by the correlation of the estimated envelope signal and a shifted version of the envelope. In one dimension of the matrix, the difference of the amount of shift (lag) of the two envelope signals is varied. In the other dimension, the phase (or initial shift or lag) of the two envelope signals is varied. The correlation can reach the maxima when the shift is an integer multiple of the beat rate. One implementation of the APM can be substantially as described in the following: (1) D. Eck and N. Casagrande. Finding meter in music using an autocorrelation phase matrix and shannon entropy. 111 *ISMIR,* 2005; (2) D. Eck. A tempo-extraction algorithm using all autocorrelation phase matrix and shannon entropy. In *MIREX,* 2005; and (3) D. Eck. Identifying metrical and temporal structure within an autocorrelation phase matrix. Music Perception, 24(2):I67-176. 2006.

The APM implementation described in this specification can be used to determine the dominant periodicity in the input audio signal and also retain the phase (or lag) in the correlation. The APM can be computed using equation (1):

$$P(k,\phi)=\sum_{i=0}^{N/k-1}\times(ki+\phi)\times(k(i+1)+\phi) \tag{1}$$

where x is the downsampled Hilbert envelope, N is the length of the envelope, k is the lag at a given row and ϕ is the lag at a given column in the APM matrix P. The detailed algorithm to compute the APM can be found, for example, in the following: D. Eck. Beat tracking using an autocorrelation phase matrix. *Proc. ICASSP*, pages IV-1313-IV-1316, 2007. The unbiased APM can be then derived by utilizing a countermatrix C as described, for example, in the following: D. Eck. Beat tracking using an autocorrelation phase matrix. Proc. ICASSP, pages IV-1313-IV-1316, 2007. Periodicities can be seen in the unbiased matrix as shown in FIG. 2D. FIG. 2D is a graph 220 that shows an APM matrix with lower amplitudes that appear darker than the higher amplitudes.

The APM described in this specification is configured to obtain results of a meter detection scheme that is more robust than a traditional APM. The traditional APM is filtered in both dimensions using a low-pass filter to remove some noise-like variations and enhance the peaks in the two-dimensional array of the APM (206). As described above, the two dimensions include the row index corresponding to the lag, k, and the column index corresponding to the phase, phi. The APM can be used to find periodicities in the envelope. The APM can be more robust than other methods because APM contains a large number of autocorrelation measurements, and thus offers a lot of initial data as basis to filter out the final result.

A filtered APM can be obtained using equation (2):

$$P_f(k,\phi)=P(k,\phi)\otimes F \tag{2}$$

where ⊗ represents the convolution operation in the two dimensions described above: the row index corresponding to the lag, k, and the column index corresponding to the phase, phi. FIG. 2E is a graph 222 that shows an exemplary lowpass filter.

The filtered APM is extended in one dimension (e.g., phi) using a circular repetition of each row of the 2D array (208). This greatly simplifies the subsequent processing steps by avoiding having to deal with a triangular shape. The subsequent processing steps would be much more difficult to apply to a triangular shaped matrix because without modification they would proceed beyond the boundaries of the triangular shape. Circular repetition of each row can be implemented using equation (3) to obtain the enlarged (extended) APM:

$$P_e(k,\phi)=P_f(k,l+(\phi-1)\text{modulo}(k)) \tag{3}$$

A circular autocorrelation is performed using the enlarged APM by correlating the APM with the enlarged APM using varying lags in the horizontal direction, e.g. phi (210). The circular autocorrelation can produce a peak for each lag that corresponds to an integer multiple of the peak interval observed in the APM. Thus, the rate of the peaks in the APM can be measured. The result of the circular autocorrelation usually shows a regular peak pattern where the peaks correspond to the strongest horizontal periodicities in the APM. The circular autocorrelation can be performed using an autocorrelation function (ACF) in equation (4):

$$\text{ACF}(l)=\Sigma_\phi\Sigma_k P_f(k,\phi)P_e(k,\phi+l) \tag{4}$$

FIG. 2F is a graph 224 that shows an extended APM matrix. The extended APM has a rectangular shape and does not show any discontinuities from the periodic extension. These properties are desired as explained above.

FIG. 2G is a graph 226 that shows an exemplary ACF. The peaks of the ACF occur in constant intervals. The interval size can indicate the beat rate. Another property of the example shown in FIG. 2G is that every 4th peak is higher, which indicates that these peaks may correspond to downbeats.

The ACF of equation (4) contains a large offset which is usually slowly varying with the lags. This offset can hinder robust detection of the most relevant peaks. The slowly varying offset in the ACF of equation (4) can be removed (212), for example, by computing another ACF on a strongly smoothed APM in both dimensions. $\text{ACF}_m$ represents an extended ACF and F represents a smoothing function in equation 5a-5c below. An example of the smoothing function is shown in FIG. 2H. The result of the other (second) ACF is a smoothed ACF ($ACF_s$) as shown in equations (5a-5c):

$$P_{f,s}(k,\phi)=P_f(k,\phi)\otimes F \quad (5a).$$

$$P_{c,s}(k,\phi)=P_c(k,\phi)\otimes F \quad (5b).$$

$$ACF_s(l)=\Sigma_\phi\Sigma_k P_{f,s}(k,\phi)P_{c,s}(k,\phi+l) \quad (5c).$$

FIG. 2H is a graph 228 that shows a smoothing function. FIG. 2I is a graph 230 that shows an unbiased correlation function $ACF_u$. When compared to FIG. 2H, FIG. 2G is shown to be more regular and the offset has been removed.

The $ACF_s$ is subtracted from the initially calculated ACF to obtain $ACF_u$ using equation (6) (214):

$$ACF_u=ACF-ACF_s \quad (6).$$

The unbiased correlation function, $ACF_u$, can be used to remove a bias or offset in the matrix which would otherwise degrade the precision of the algorithm. The bias (or offset) has only frequency components below the frequency range at which downbeats are expected to be found. Thus, all components can be removed in this very low frequency range.

The remaining DC offset (and very low frequencies as described above) is removed (216), for example, by fitting a polynomial to the offset, d, and subtracting it from $ACF_u$ as shown in equation (7). The result of equation (7) is $ACF_n$. Removing the DC offset allows the peaks of the ACF to be identified. The detected peaks in the ACF are associated with periodic occurrences of beats. Thus, each peak shows the periodicity interval (frequency) of beat occurrences. From the detected peaks in the ACF, only the relevant peaks, which are usually the highest peaks with the shortest lag are identified. The space between peaks is near zero after the offset, d, is removed. The DC offset can be obtained by fitting a seven degree polynomial to the function.

$$ACF_n=ACF_u-d \quad (7).$$

FIG. 2J is a graph 232 that shows a DC offset estimate. FIG. 2K is a graph 234 that shows an ACF after removal of DC offset estimate.

FIG. 2L is another process flow diagram of an example process 130 for detecting a meter in an input audio signal. The process described in FIG. 2L can be combined with the process described in FIG. 2C. FIGS. 2M-2U represent various data graphs associated with the process described in FIG. 2L.

Figure 2M:
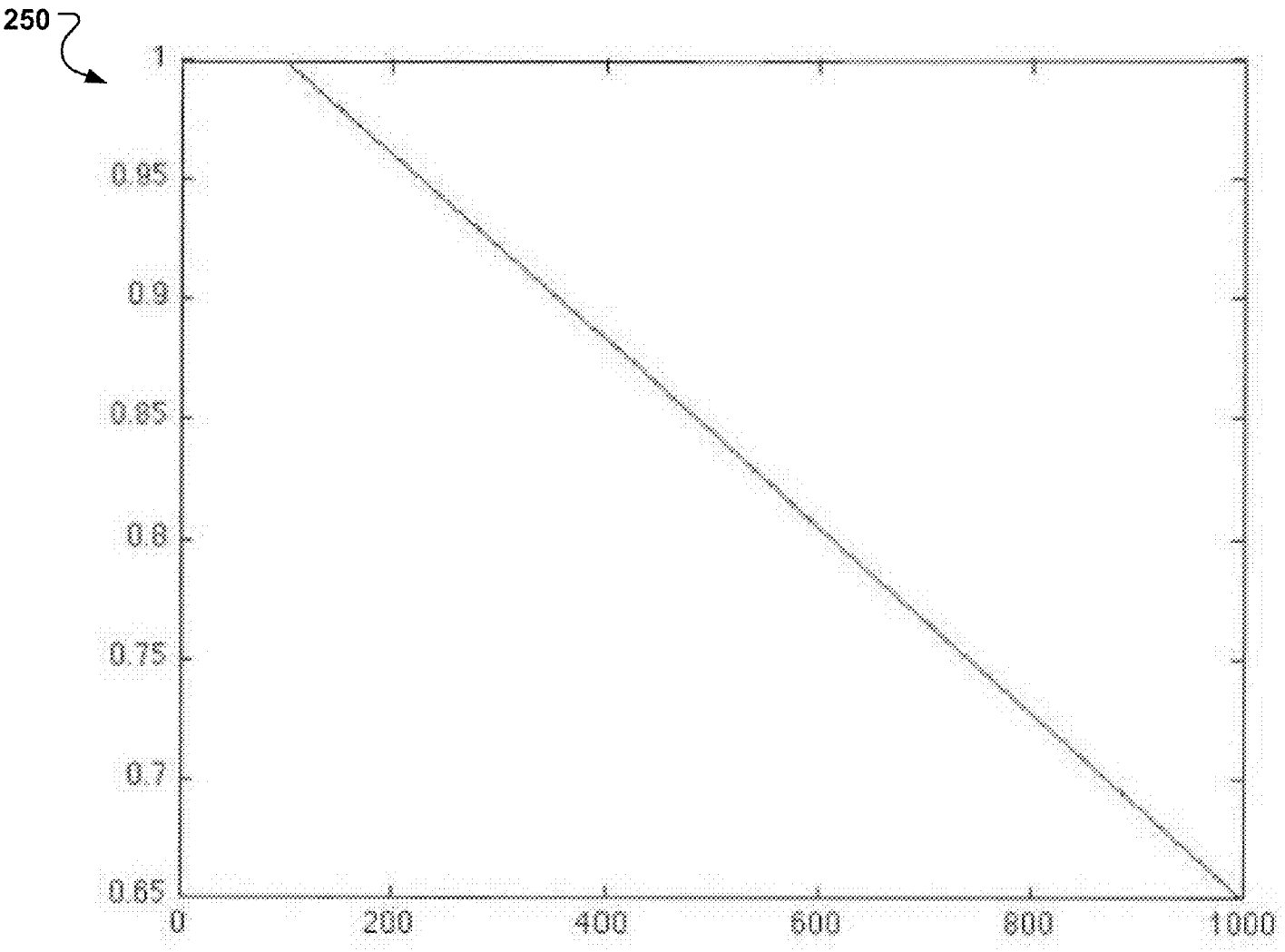
FIG. 2M is a graph that shows an exemplary weighting function.
Figure 2N:
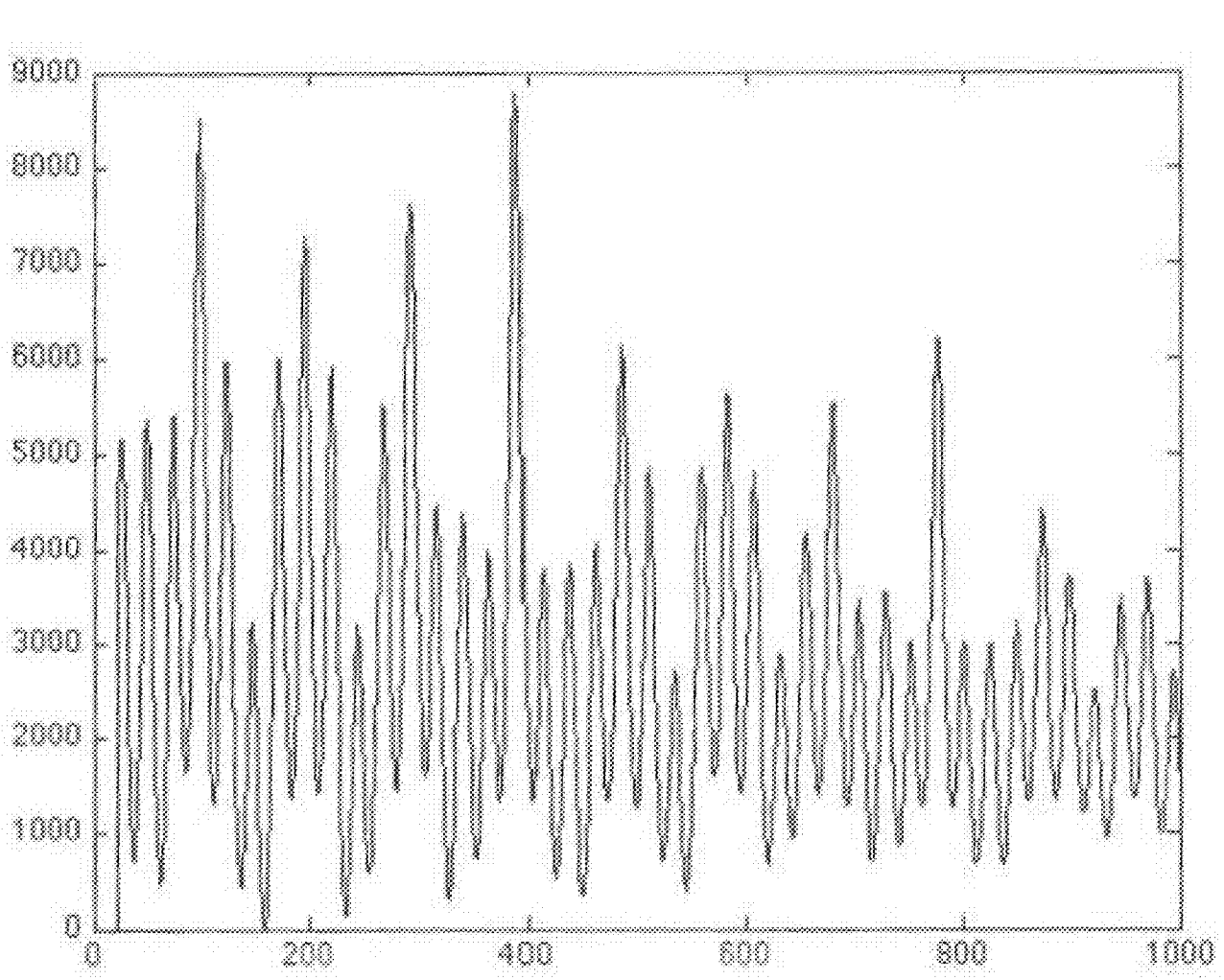
FIG. 2N is a graph that shows a weighted ACF.

As shown in FIG. 2L, a data processing system or apparatus can filter the $ACF_n$ using a weighting function, such as the one shown in equation (8), to give less weight to longer lags, thereby reducing the number of false detections at multiple bar lengths (240). The weighing function is used to identify the meter. With the weighting, the correct meter rather than integer multiples of the meter can be identified. FIG. 2M is a graph 250 that shows an exemplary weighting function. FIG. 2N is a graph 252 that shows a weighted ACF.

$$ACF_w=ACF_n*\text{weight} \quad (8)$$

The location, m, of the highest peak is identified (242), and all other peaks with larger lags are removed (see FIG. 2O) (244). Those peaks with larger lags are irrelevant for further analysis. The highest peak corresponds to a repetition interval that has the largest similarity between all concatenated intervals of that size in the audio input signal. The highest peak can represent the bar size or multiples of the bar size. The location, m, can be identified using equation (9):

$$m=\max(ACF_s) \quad (9).$$

Equation (10) can be used to remove all peaks beyond the highest peak.

$$ACF_s(m,m+1,\ldots,N)=0 \quad (10).$$

Figure 2O:
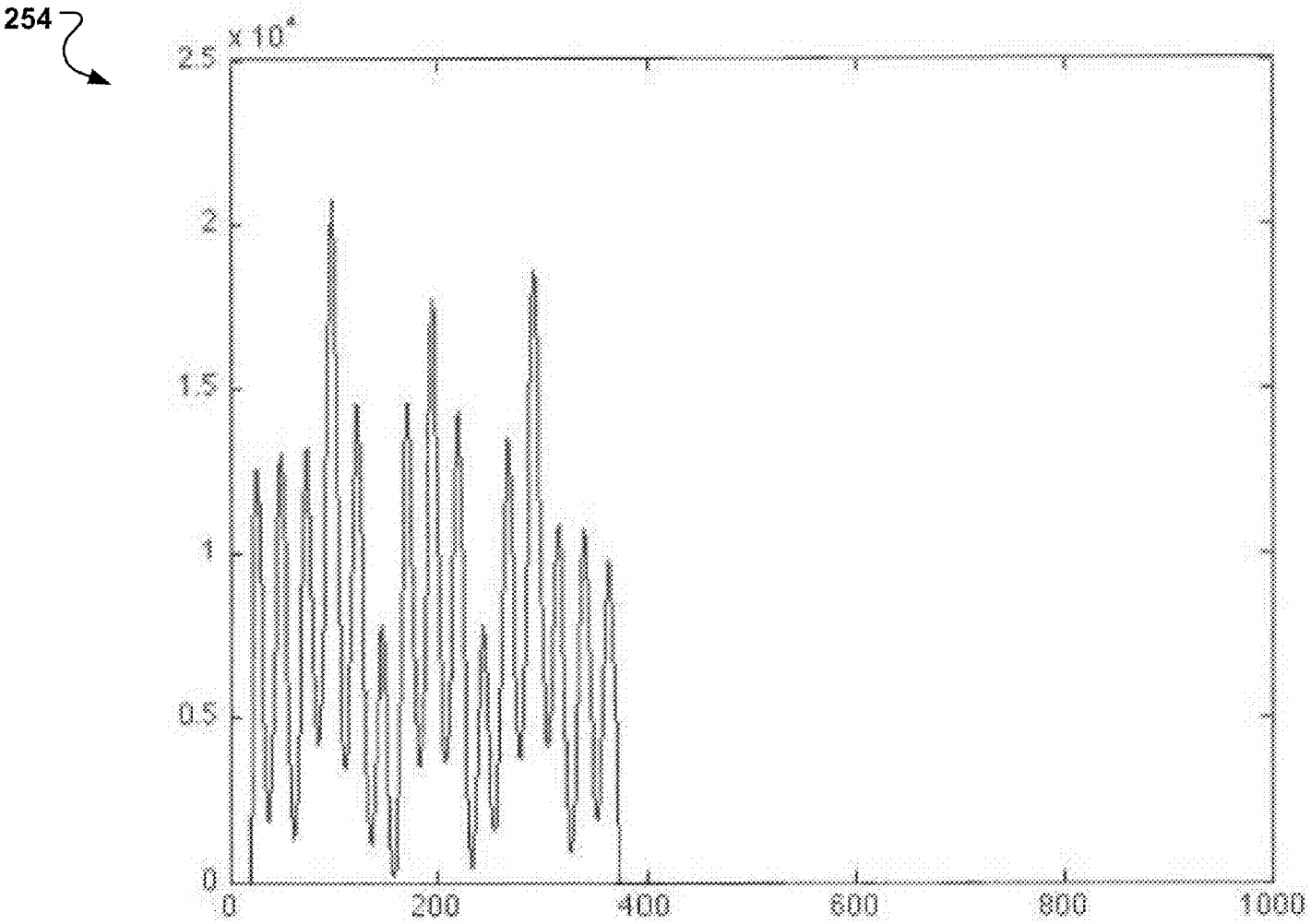
FIG. 2O is a graph that shows an ACF with a largest peak removed.

FIG. 2O is a graph 254 that shows the ACF with the largest peak and all peaks beyond it removed. FIG. 2O shows further reduction of the search space of actual meter by throwing out lags that are not important.

The ACF can be cleaned (246), for example, by zeroing out entries below a threshold value using equation (11):

$$ACF(\text{find}(ACF<\text{thresh}))=0 \quad (11).$$

Figure 2P:
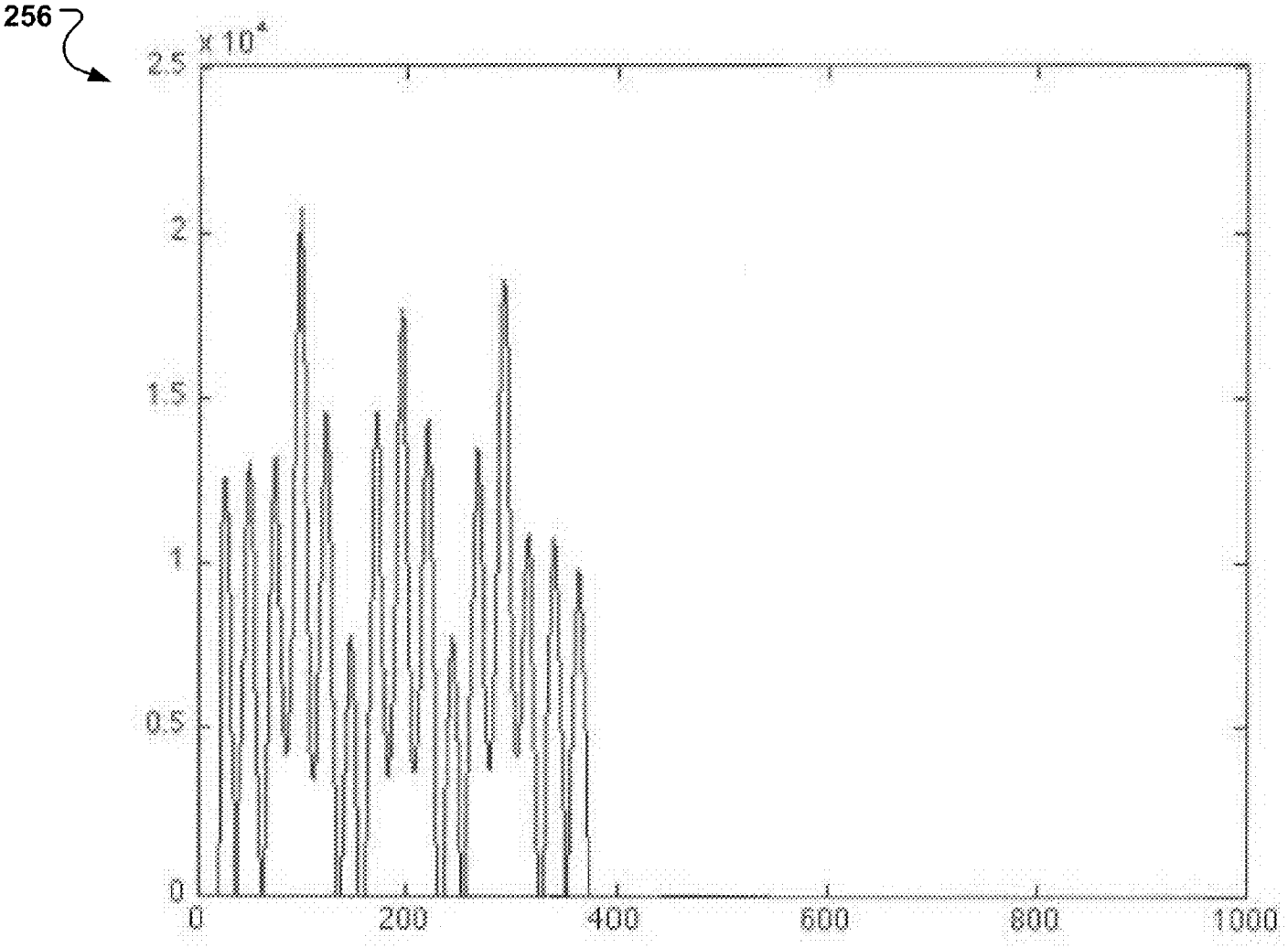
FIG. 2P is a graph that shows a threshold ACF.

A threshold value of 10% of the maximum value can be used in equation (11). Thresholding can be performed to avoid false detection of spurious peaks which are too small to be relevant. There are no absolute ranges for the threshold values. For example, a threshold value of 10 is determined based on empirical data. However, choosing too small a range may not remove the spurious peaks, and choosing too large a range may remove peaks of interest. FIG. 2P is a graph 256 that shows a threshold ACF.

The ACF is tested against multiple (e.g., seven) meter templates to determine which template matches the pattern of peaks in the ACF (248). Examples of the meter templates can include 2/2, 3/4, 4/4, 5/4, 6/8, 7/9, and 8/8 meter. More or less total number of meters can be used in the meter template. Having less numbers can improve accuracy because fewer patterns are available to choose from. The meter template test can be performed as follows: for each meter candidate, for each sub peak p, the ACF can be tested to determine whether p is a distance away from m (the maximum peak lag) that supports the meter template (plus an error tolerance). For illustrative purposes, the tolerance can be selected as 1.5% of m (the maximum peak lag). The selected value for the tolerance can vary depending on the audio signal database. There is a range of for this value which will lead to good overall results. But I cannot exactly specify the range. If the peak, p, is within this range, the strength is added to an overall strength of that candidate. The strength here represents the amplitude in the function plotted in FIG. 2P, for example.

Figure 2Q:
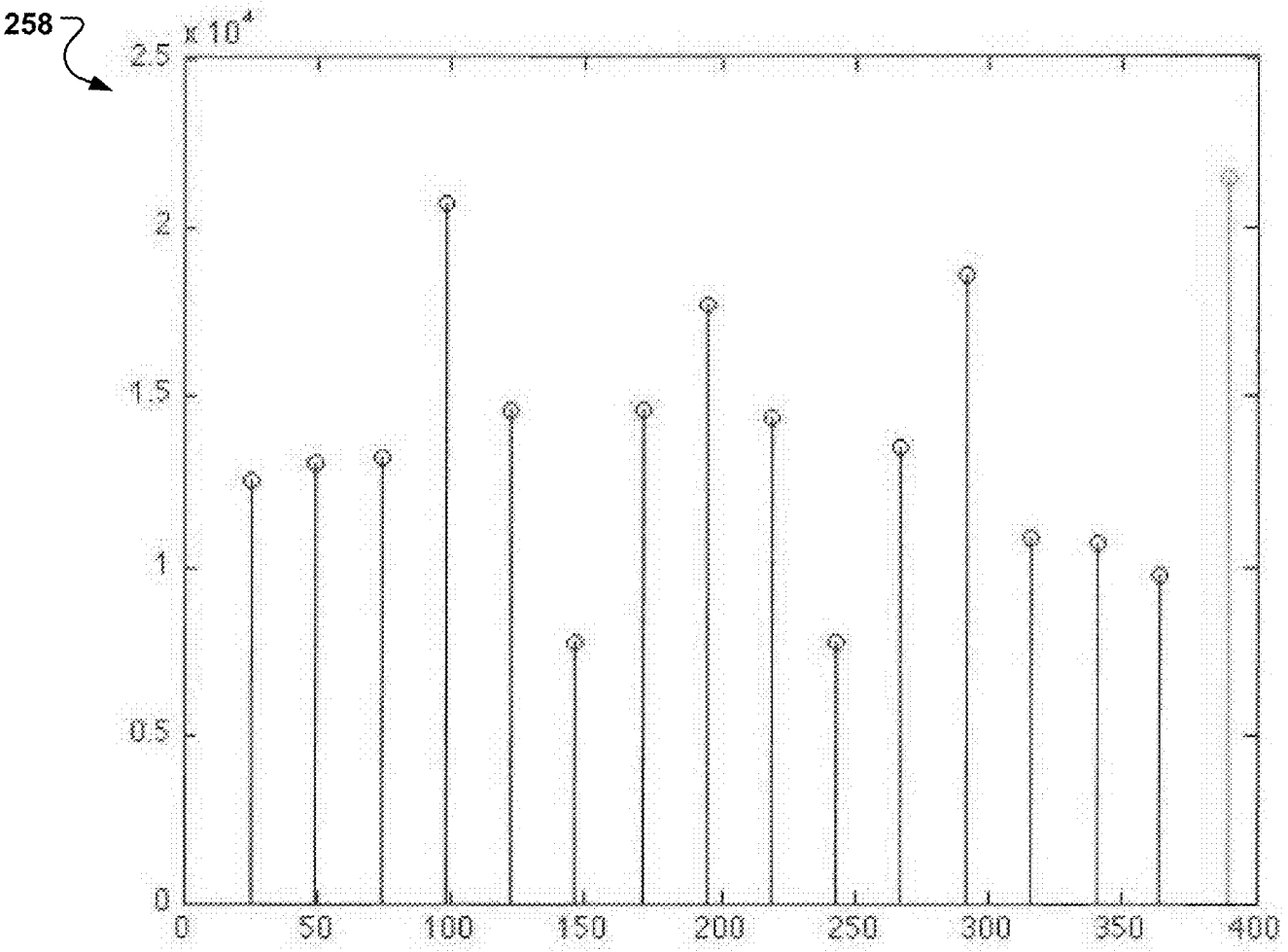
FIG. 2Q is a graph that shows subpeaks found in an ACF.
Figure 2R:
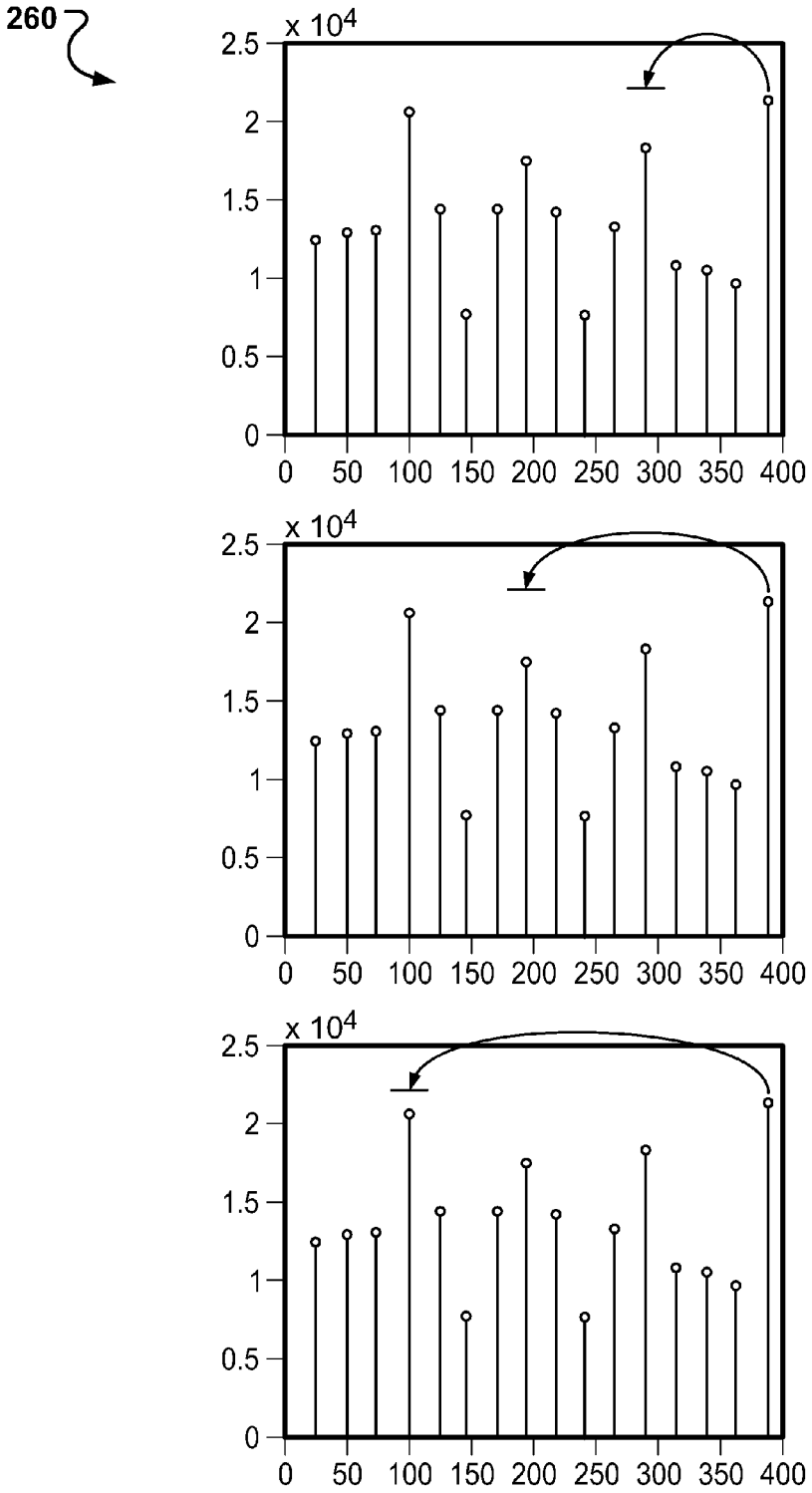
FIG. 2R is a graph that demonstrates matching tests performed for each meter candidate.
Figure 2S:
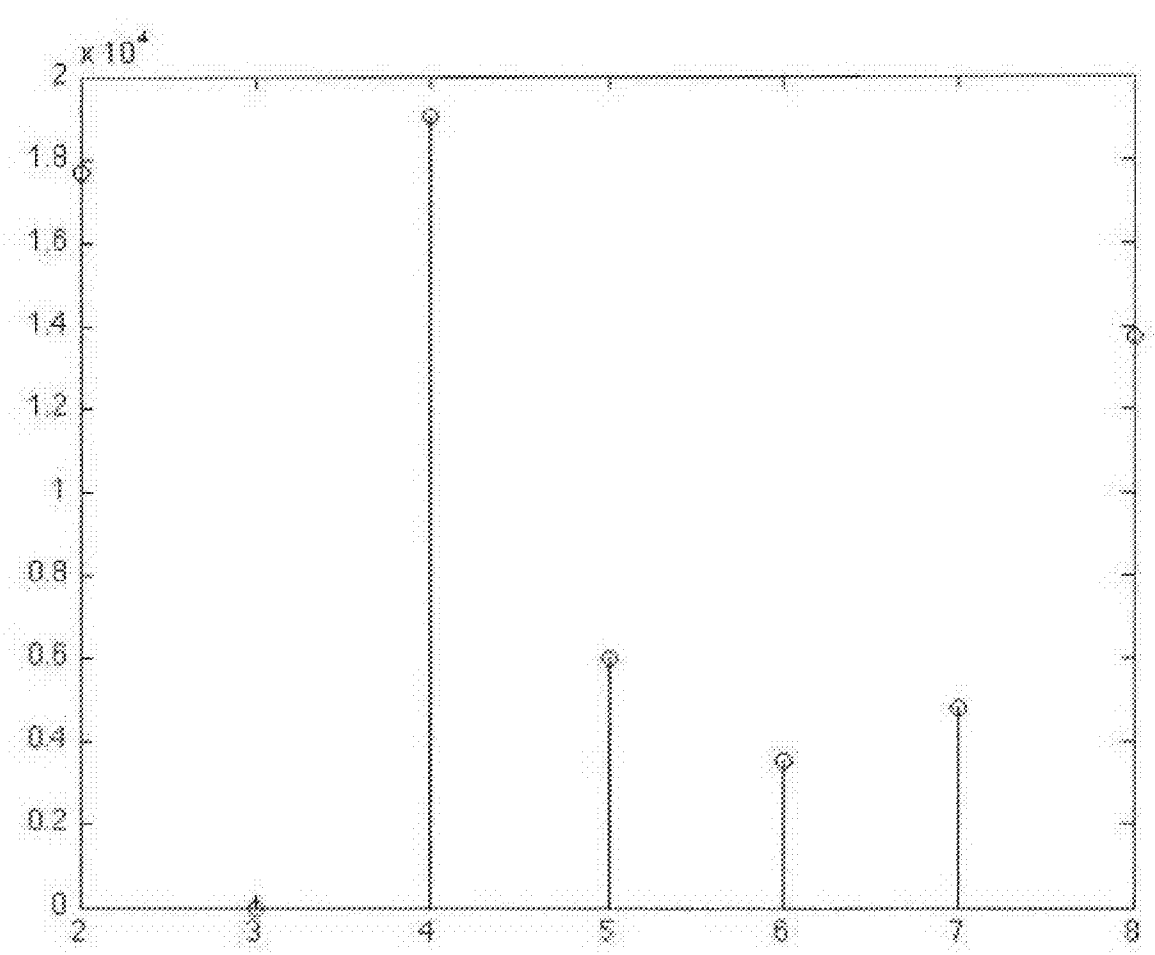
FIG. 2S is a graph that shows an accumulated strength of each candidate meter.

FIG. 2Q is a graph 258 that shows the subpeaks found in the ACP. FIG. 2R is a graph 260 that demonstrates the matching tests performed for each meter candidate. The back bar indicates the allowable error. FIG. 2S is a graph 262 that shows the accumulated strength of each candidate meter. The peaks in the function are used and matched to determine their relationship to one another. The peaks can exhibit a ratio in their location that will follow a template relationship and expose the true meter.

Figure 2T:
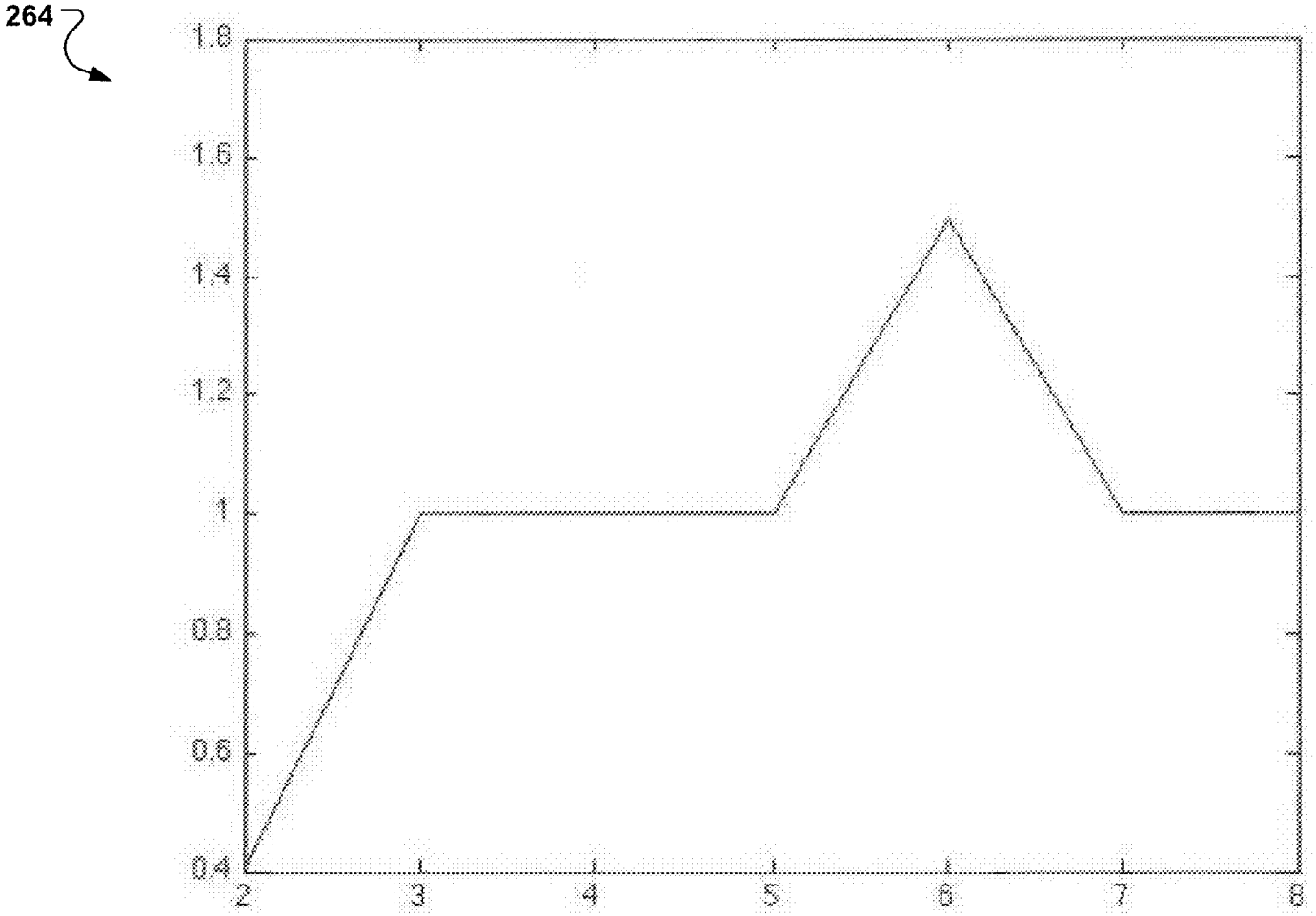
FIG. 2T is a graph that shows a weighting function profile for each candidate meter.
Figure 2U:
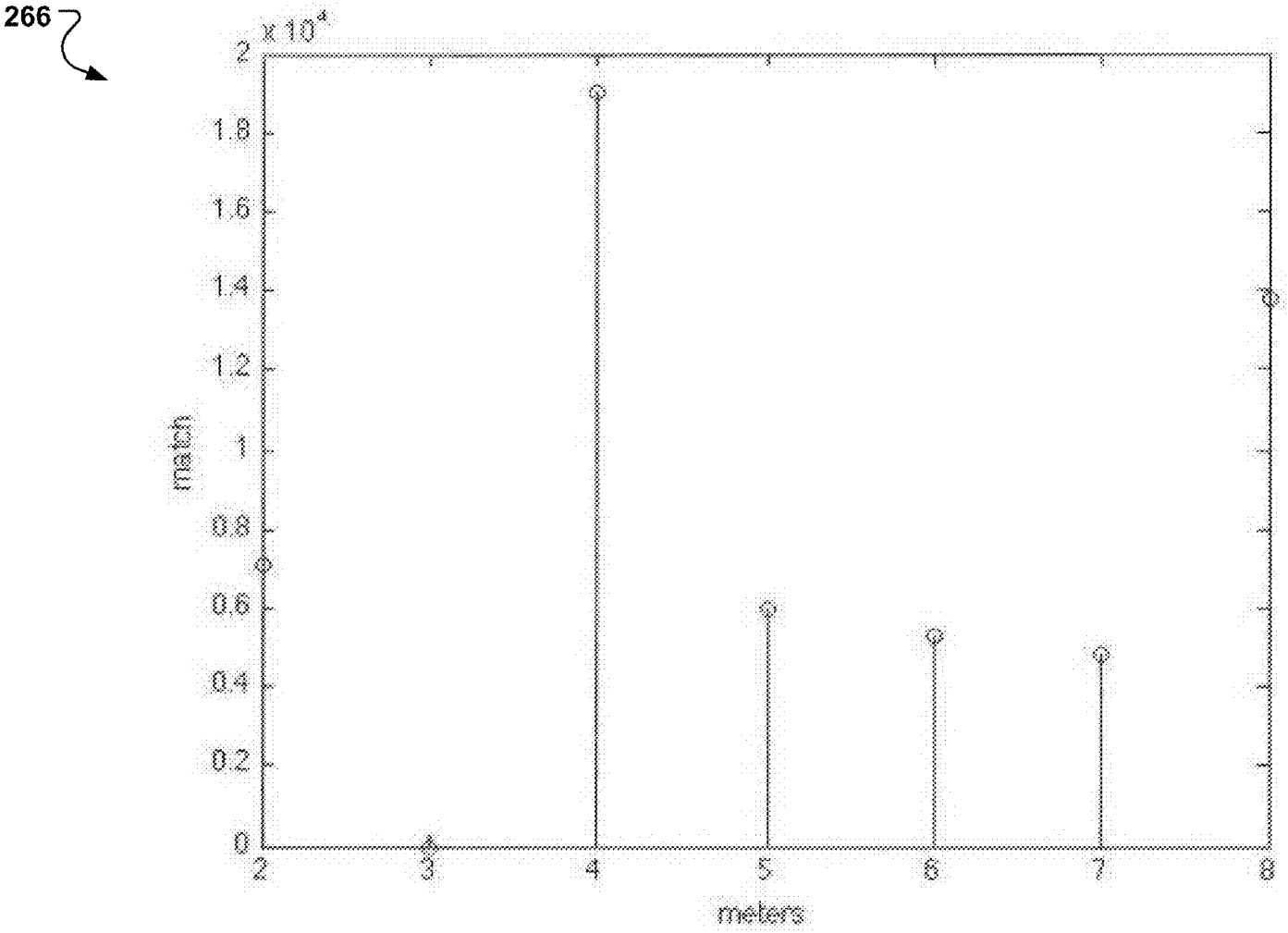
FIG. 2U is a graph that shows template matching results.

This strength result can be weighted to favor certain meters. FIG. 2T is a graph 264 that shows the weighting function profile for each candidate meter. The weighted strength results show that one template may have a better match to the peaks than another as shown in FIG. 2U. FIG. 2U is a graph 266 that shows template matching results. Based on the template matching results, the meter can be identified.

The foregoing meter detection operations can be performed using a meter detection unit, which may be implemented as a functional module composed of circuitry and/or software. An example of the meter detection unit is provided in FIG. 4 below.

Figure 3A:
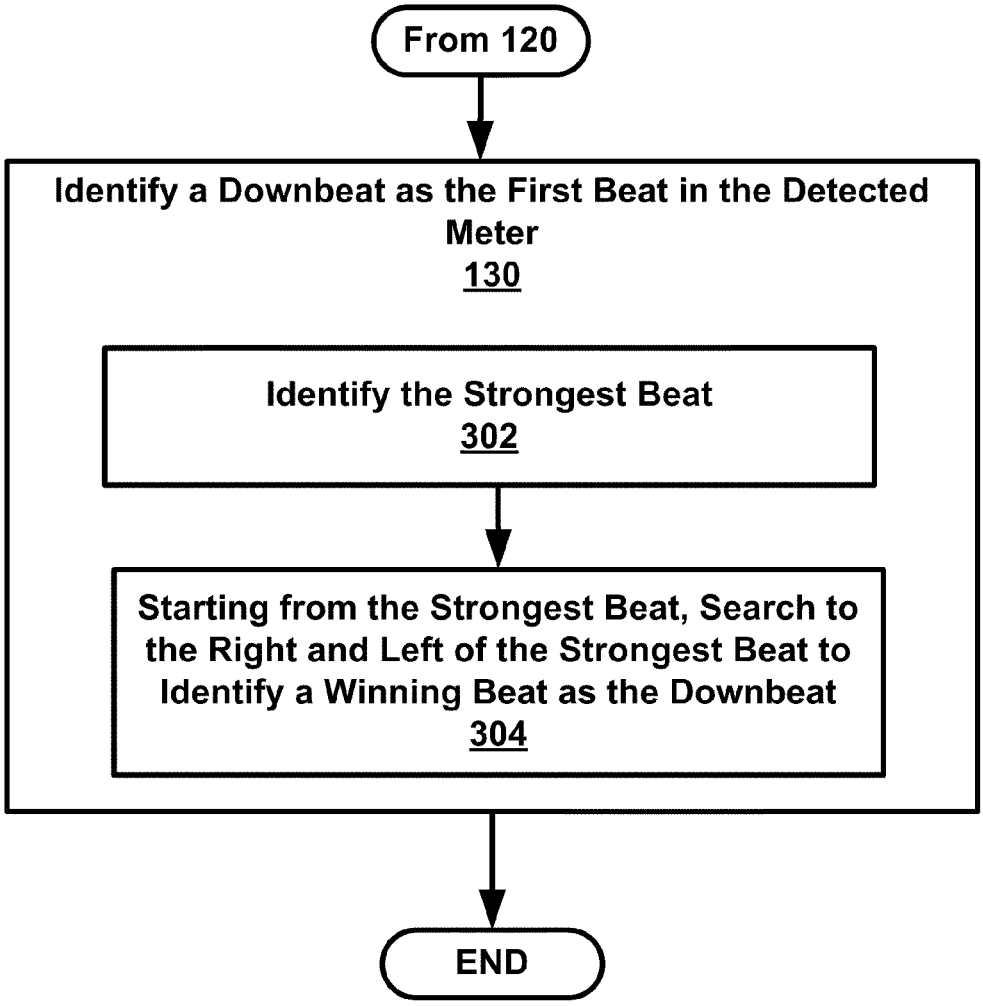
FIG. 3A is a process flow diagram showing an exemplary process for identifying downbeats in the input audio signal.
Figure 3B:
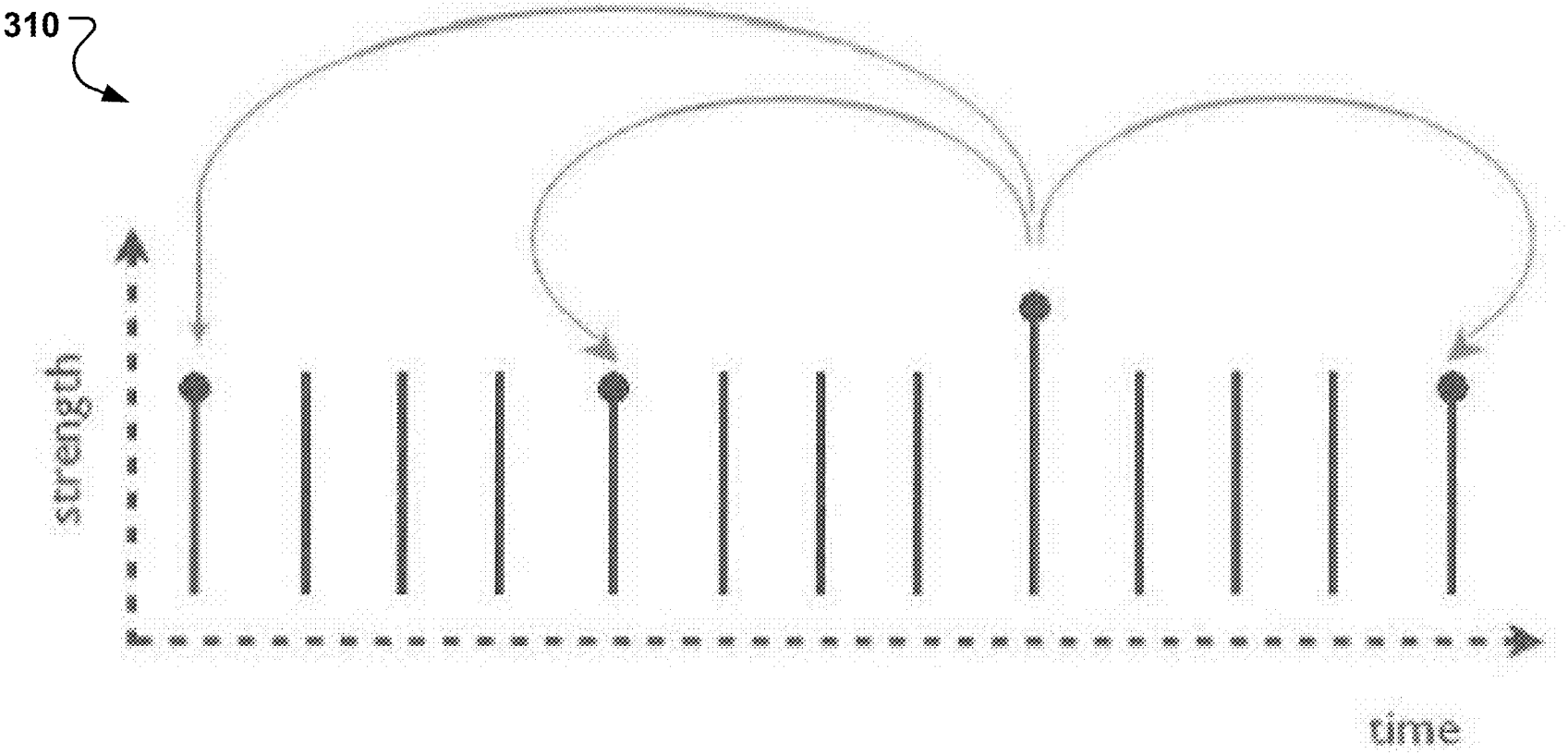
FIG. 3B is a graph that shows that starting from the strongest beat, one can move to the left and to the right of the strongest beat by the winning meter and mark each of those beats as a downbeat.

Using the identified meter, the downbeats can be placed in the input audio input signal. FIG. 3A is a process flow diagram showing an exemplary process 130 for identifying downbeats in the input audio signal. A system or apparatus can identify the strongest beat among the beats in the input audio signal (302). Starting from the strongest beat, the system or apparatus can move left of right by the winning meter and mark each of those as a downbeat. FIG. 3B is a graph 310 that shows that starting from the strongest beat, one can move to the left and to the right of the strongest beat by the winning meter and mark each of those beats as a downbeat. For example, in FIG. 3B the winning meter is the one with the highest peak, 4. For example, the beats are counted starting from the strongest beat and each of those strongest beat is marked as a downbeat as shown in equation (12):

$$\text{downbeat}=\text{beat}_{max}\pm i*\text{meter} \tag{12}$$

Using the strongest beat can be useful because the strongest beat is most likely to occur after the introduction of a song, and thus follows the true beat alignment.

Additionally, the process can start from a beat other than the strongest beat. For example, the process can start from the first beat. However, when the first detected beat is used to start the process, downbeats can be placed to a beat grid that may change as the introduction of a song, may not necessarily obey the true beat structure.

The foregoing downbeat detection operations can be performed using a downbeat detection unit, which may be implemented as a functional module composed of circuitry and/or software. An example of the downbeat detection unit is provided in FIG. 4 below.

Downbeat Detection System

Figure 4:
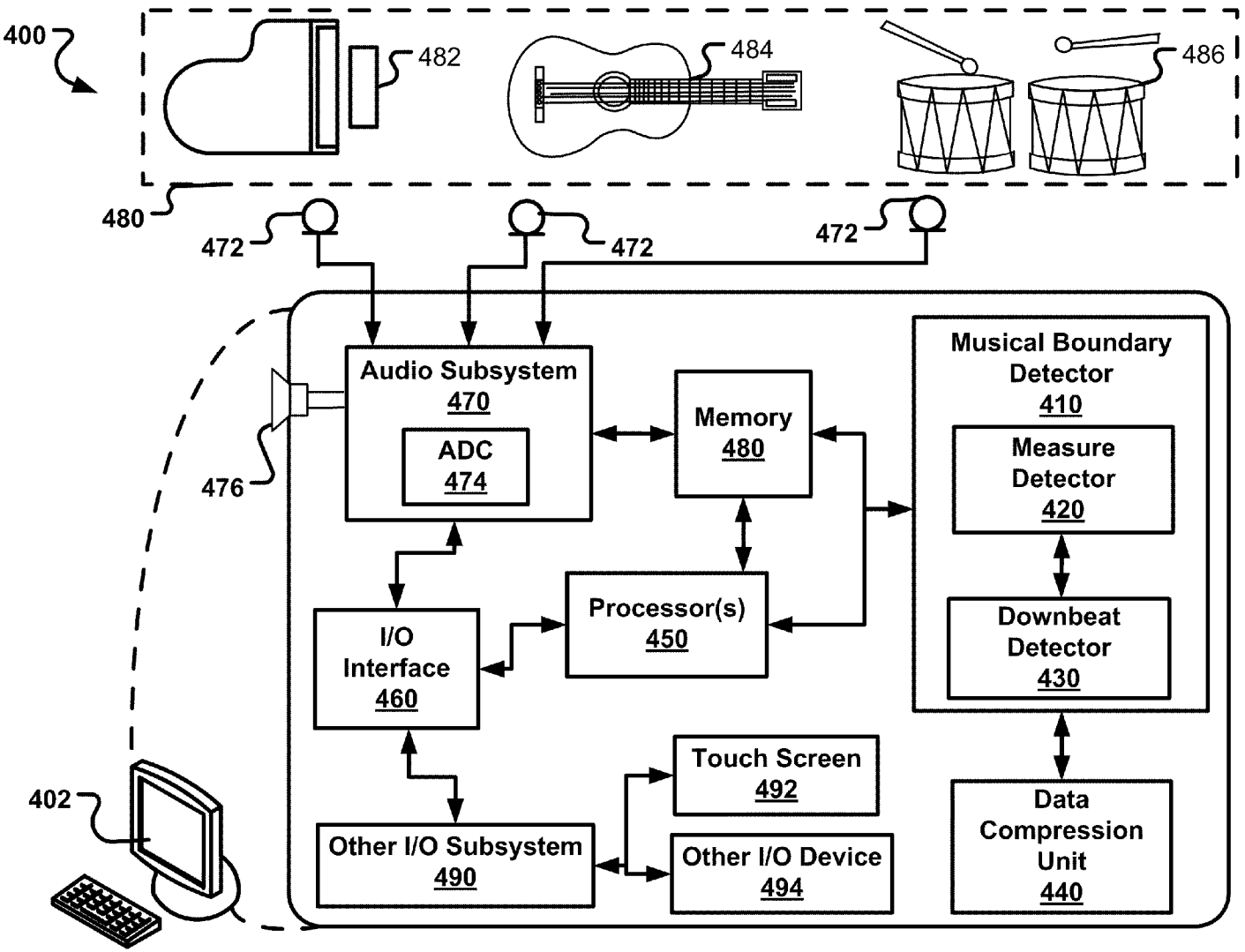
FIG. 4 is a block diagram of a system for detecting musical structures, such as downbeats in a target audio signal.

FIG. 4 is a block diagram of a system or a data processing apparatus for detecting musical structures, such as downbeats in a target audio signal. The downbeat detection system 400 can include a data processing system 402 for performing digital signal processing. The data processing system 402 can include one or more computers (e.g., a desktop computer or a laptop), a smartphone, personal digital assistant, etc. The data processing system 402 can include various components, such as a memory 480, one or more data processors, image processors and/or central processing units 450, an input/output (I/O) interface 460, an audio subsystem 470, other I/O subsystem 490 and a musical boundary detector 410. The memory 480, the one or more processors 450 and/or the I/O interface 460 can be separate components or can be integrated in one or more integrated circuits. Various components in the data processing system 400 can be coupled together by one or more communication buses or signal lines.

Sensors, devices, and subsystems can be coupled to the I/O interface 460 to facilitate multiple functionalities. For example, the I/O interface 460 can be coupled to the audio subsystem 470 to receive audio signals. Other I/O subsystems 490 can be coupled to the I/O interface 460 to obtain user input, for example.

The audio subsystem 470 can be coupled to one or more microphones 472 and a speaker 476 to facilitate audio-enabled functions, such as voice recognition, voice replication, digital recording, and telephony functions. For digital recording function, each microphone can be used to receive and record a separate audio track from a separate audio source 480. In some implementations, a single microphone can be used to receive and record a mixed track of multiple audio sources 480.

For example, FIG. 4 shows three different sound sources (or musical instruments) 480, such as a piano 482, guitar 484 and drums 486. A microphone 472 can be provided for each instrument to obtain three separate tracks of audio sounds. To process the received analog audio signals, an analog-to-digital converter (ADC) 474 can be included in the data processing system 402. For example, the audio subsystem 470 can be included in the ADC 474 to perform the analog-to-digital conversion.

The I/O subsystem 490 can include a touch screen controller and/or other input controller(s) for receiving user input. The touch-screen controller can be coupled to a touch screen 492. The touch screen 492 and touch screen controller can, for example, detect contact and movement or break thereof using any of multiple touch sensitivity technologies, including but not limited to capacitive, resistive, infrared, and surface acoustic wave technologies, as well as other proximity sensor arrays or other elements for determining one or more points of contact with the touch screen 492. Also, the I/O sub system can be coupled to other I/O devices, such as a keyboard, mouse, etc.

The musical boundary detector 410 can include a measure detector 420 and a downbeat detector 430. The musical boundary detector 410 can receive a digitized streaming audio signal from the processor 450, which can receive the digitized streaming audio signal from the audio subsystem 470. Also, the audio signals received through the audio subsystem 470 can be stored in the memory 480. The stored audio signals can be accessed by the musical boundary detector 410. The musical boundary detector 410 is configured to perform the processes described with respect to FIGS. 1-3B.

The boundaries detected by the musical boundary detector 410 can be used to perform other operations. For example, the musical boundary detector 410 can communicate with a data compression unit 440 to perform data compression using the boundaries as markers for the compression. For example, the detected boundaries can be used to deconstruct the input audio signal into multiple components or segments.

Each component can be compressed separately as different blocks. In addition, the detected boundaries or the deconstructed components of the audio signal can be used as triggers to perform other operations as described below.

Examples of Useful Tangible Applications

There are several technologies that could benefit from transcribing an audio signal from a stream of numbers into features that are musically important (e.g., downbeats). For example, using the downbeat information applications such as audio and video editing software can provide the user with editing points that will aid audio/video synchronization. In addition, downbeats can be used to re-align recorded music. Downbeats can also be used in automated DJ applications where two songs can be mixed together by aligning beats and bar times. Additionally, downbeats can be used for audio data compression algorithms. The downbeats can be used as markers for segmenting and compressing the audio data.

Also, downbeats can be used to synchronize audio data with corresponding video data. For example, one could synchronize video transition times to downbeats in a song.

In general, the detected downbeats can be stored in the memory component (e.g., memory 480) and used as a trigger for something else. For example, the detected onsets can be used to synchronize media files (e.g., videos, audios, images, etc.) to the downbeats.

Other applications of onsets can include using the detected downbeats to control anything else, whether related to the audio signal or not. For example, downbeats can be used as triggers to synchronize one thing to other things. For example, image transition in a slide show can be synchronized to the detected downbeats. In another example, the detected downbeats can be used to trigger sample playback. The result can be an automatic accompaniment to any musical track. By adjusting the sensitivity, the accompaniment can be more or less prominent in the mix.

The techniques for implementing the contextual voice commands as described in FIGS. 1-4 may be implemented using one or more computer programs comprising computer executable code stored on a non-transitory tangible computer readable medium and executing on the data processing device or system. The computer readable medium may include a hard disk drive, a flash memory device, a random access memory device such as DRAM and SDRAM, removable storage medium such as CD-ROM and DVD-ROM, a tape, a floppy disk, a Compact Flash memory card, a secure digital (SD) memory card, or some other storage device. In some implementations, the computer executable code may include multiple portions or modules, with each portion designed to perform a specific function described in connection with FIGS. 1-4. In some implementations, the techniques may be implemented using hardware such as a microprocessor, a microcontroller, an embedded microcontroller with internal memory, or an erasable, programmable read only memory (EPROM) encoding computer executable instructions for performing the techniques described in connection with FIGS. 1-4. In other implementations, the techniques may be implemented using a combination of software and hardware.

Processors suitable for the execution of a computer program include, by way of example, both general and special purpose microprocessors, and any one or more processors of any kind of digital computer, including graphics processors, such as a GPU. Generally, the processor will receive instructions and data from a read only memory or a random access memory or both. The elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. Information carriers suitable for embodying computer program instructions and data include all forms of non volatile memory, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, the systems apparatus and techniques described here can be implemented on a data processing device having a display device (e.g., a CRT (cathode ray tube) or LCD (liquid crystal display) monitor) for displaying information to the user and a positional input device, such as a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

While this specification contains many specifics, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Only a few implementations and examples are described and other implementations, enhancements and variations can be made based on what is described and illustrated in this application.

What is claimed is:

1. A method performed by a data processing device, the method comprising:

receiving an input audio signal;

detecting a meter in the received audio signal, detecting the meter comprising generating an envelope of the received audio signal, generating an autocorrelation phase matrix having a two-dimensional array based on the generated envelope to identify a dominant periodicity in the received audio signal, and filtering both dimensions of the generated autocorrelation phase matrix to enhance peaks in the two-dimensional array, wherein the meter represents a time signature of the input audio signal having multiple beats; and identifying a downbeat as a first beat in the detected meter.

2. The method of claim 1, wherein generating the envelope comprises:

generating an analytic signal based on the received input audio signal.

3. The method of claim 1, wherein detecting the meter further comprises:

downsampling the generated envelope to reduce a complexity of the estimated envelope.

4. The method of claim 1, wherein detecting the meter further comprises:

determining a correlation between the generated envelope and a time shifted version of the generated envelope, wherein the time shifted version is shifted in time by a time lag.

5. The method of claim 4, wherein the time lag represents an integer multiple of a beat rate of the received input audio signal.

6. The method of claim 4, wherein generating the autocorrelation phase matrix comprises:

computing the autocorrelation phase matrix having the two-dimensional array based on the determined correlation, wherein a first dimension of the two-dimensional array is associated with the time lag and a second dimension of the two-dimensional array is associated with a phase shift between the generated envelope and the time shifted version.

7. The method of claim 6, wherein computing the autocorrelation phase matrix comprises:

varying a length of the time lag in the first dimension; and varying a size of the phase shift in the second dimension.

8. The method of claim 6, wherein detecting the meter further comprises:

generating an enlarged autocorrelation phase matrix by extending the filtered autocorrelation phase matrix in the second dimension to avoid a triangular shape in the autocorrelation phase matrix.

9. The method of claim 8, wherein detecting the meter further comprises:

performing a circular autocorrelation operation on the generated enlarged autocorrelation phase matrix using an autocorrelation function.

10. The method of claim 9, wherein detecting the meter further comprises:

generating a smoothed autocorrelation function that removes a variable offset from the autocorrelation function.

11. The method of claim 10, wherein detecting the meter further comprises:

subtracting the generated smoothed autocorrelation function from the autocorrelation function;

removing a DC offset from a result of the subtracting; and identifying peaks of the autocorrelation function.

12. The method of claim 11, wherein detecting the meter in the received audio signal further comprises:

applying a weighting function to the autocorrelation function to reduce a number of false detection of peaks.

13. The method of claim 12, wherein detecting the meter further comprises:

identifying a location of a highest peak from the detected peaks; and removing remaining peaks from the autocorrelation function.

14. The method of claim 13, wherein detecting the meter further comprises:

cleaning the autocorrelation function using a threshold value.

15. The method of claim 14, wherein detecting the meter further comprises:

testing the autocorrelation function using multiple meter templates; and responsive to the testing, identifying the meter in the received audio signal.

16. The method of claim 1, wherein identifying a downbeat as a first beat in the detected meter comprises:

identifying a strongest beat from the multiple beats within the detected meter; and comparing the identified strongest beat with neighboring beats to detect the downbeat as the first beat in the detected meter.

17. The method of claim 1, wherein identifying a downbeat as a first beat in the detected meter comprises:

identifying a first beat from the multiple beats within the detected meter; and comparing the identified first beat with neighboring beats to detect the downbeat as the first beat in the detected meter.

18. The method of claim 1, comprising:

using the detected downbeat to synchronize the received audio signal with a video signal.

19. A non-transitory machine readable medium storing instructions which, when executed by a data processing device, cause the data processing device to perform a method comprising:

receiving an input audio signal;

detecting a meter in the received audio signal, detecting the meter comprising generating an envelope of the received audio signal, generating an autocorrelation phase matrix having a two-dimensional array based on the generated envelope to identify a dominant periodicity in the received audio signal, and filtering both dimensions of the generated autocorrelation phase matrix to enhance peaks in the two-dimensional array, wherein the meter represents a time signature of the input audio signal having multiple beats; and identifying a downbeat as a first beat in the detected meter.

20. The medium of claim 19, wherein generating the envelope comprises:

generating an analytic signal based on the received input audio signal.

21. The medium of claim 19, wherein detecting the meter further comprises:

determining a correlation between the generated envelope and a time shifted version of the generated envelope, wherein the time shifted version is shifted in time by a time lag, and wherein the time lag represents an integer multiple of a beat rate of the received input audio signal.

22. The medium of claim 21, wherein generating the autocorrelation phase matrix comprises:

computing the autocorrelation phase matrix having the two-dimensional array based on the determined correlation, wherein a first dimension of the two-dimensional array is associated with the time lag and a second dimension of the two-dimensional array is associated with a phase shift between the generated envelope and the time shifted version.

23. The medium of claim 22, wherein computing the autocorrelation phase matrix comprises:

varying a length of the time lag in the first dimension; and varying a size of the phase shift in the second dimension; and wherein detecting the meter further comprises:

generating an enlarged autocorrelation phase matrix by extending the filtered autocorrelation phase matrix in the second dimension to avoid a triangular shape in the autocorrelation phase matrix; and performing a circular autocorrelation operation on the generated enlarged autocorrelation phase matrix using an autocorrelation function.

24. The medium of claim 23, wherein detecting the meter further comprises:

generating a smoothed autocorrelation function that removes a variable offset from the autocorrelation function; and subtracting the generated smoothed autocorrelation function from the autocorrelation function;

removing a DC offset from a result of the subtracting; and identifying peaks of the autocorrelation function.

25. The medium of claim 19, the method comprising:

using the detected downbeat to synchronize the received audio signal with a video signal.

* * * * *